US008997641B2

(12) United States Patent
Yamamoto et al.

(10) Patent No.: US 8,997,641 B2
(45) Date of Patent: Apr. 7, 2015

(54) AUTOMATIC BANDING PACKING MACHINE AND AUTOMATIC BANDING PACKING SYSTEM

(75) Inventors: Keisho Yamamoto, Tokyo (JP); Yoshikatsu Aizawa, Kawasaki (JP); Mitsuru Sato, Kawasaki (JP); Eiji Tobita, Kawasaki (JP)

(73) Assignee: Strapack Corporation, Tokyo (JP)

( * ) Notice: Subject to any disclaimer, the term of this patent is extended or adjusted under 35 U.S.C. 154(b) by 189 days.

(21) Appl. No.: 12/670,021

(22) PCT Filed: Jul. 10, 2008

(86) PCT No.: PCT/JP2008/062455

§ 371 (c)(1),
(2), (4) Date: Jan. 21, 2010

(87) PCT Pub. No.: WO2009/014008

PCT Pub. Date: Jan. 29, 2009

(65) Prior Publication Data

US 2010/0205914 A1 Aug. 19, 2010

(30) Foreign Application Priority Data

Jul. 26, 2007 (JP) ..... 2007-194588

(51) Int. Cl.

| | |
|---|---|
| ***B65B 13/06*** | (2006.01) |
| ***B65B 65/00*** | (2006.01) |
| ***B65B 13/18*** | (2006.01) |

(52) U.S. Cl.

CPC ..... *B65B 65/003* (2013.01); *B65B 13/06* (2013.01); *B65B 13/18* (2013.01)

(58) Field of Classification Search

USPC ..... 100/7, 25, 26; 53/580, 582, 589

See application file for complete search history.

(56) References Cited

U.S. PATENT DOCUMENTS

| | | | | |
|---|---|---|---|---|
| 4,578,933 | A | 4/1986 | Lang et al. | |
| 5,078,057 | A * | 1/1992 | Pearson | 100/25 |
| 5,379,687 | A * | 1/1995 | Moseley | 100/3 |
| 5,842,327 | A | 12/1998 | Schwede | |
| 6,470,655 | B1 * | 10/2002 | Schwede | 53/586 |
| 7,028,609 | B2 * | 4/2006 | Ozga et al. | 100/26 |
| 7,150,222 | B2 * | 12/2006 | Schuttler et al. | 100/26 |
| 2003/0033941 | A1 | 2/2003 | Ozga et al. | |
| 2005/0139092 | A1 | 6/2005 | Schuttler et al. | |

FOREIGN PATENT DOCUMENTS

| | | | |
|---|---|---|---|
| DE | 3303956 | A1 | 8/1984 |
| DE | 19615009 | A1 | 10/1997 |

(Continued)

*Primary Examiner* — Jimmy T Nguyen
(74) *Attorney, Agent, or Firm* — The Webb Law Firm

(57) ABSTRACT

An automatic banding packing machine is provided with a packing machine body having an upper-face table on which the object to be packed passes, a pair of vertical band guide arches arranged separately from each other above the upper-face table in a direction parallel with a passage direction of the object to be packed, and a horizontal band guide arch arranged above the upper-face table in the direction parallel with the passage direction of the object to be packed, and the pair of vertical band guide arches is configured to be movable between a standby position separated from the horizontal band guide arch and a communication position communicating with the horizontal band guide arch in a direction orthogonal to the passage direction of the object to be packed.

1 Claim, 18 Drawing Sheets

(56) References Cited

FOREIGN PATENT DOCUMENTS

| | | | |
|---|---|---|---|
| EP | 1238909 | A1 | 9/2002 |
| JP | 61127410 | A | 6/1986 |
| JP | 2003200904 | A | 7/2003 |
| JP | 2006290431 | A | 10/2006 |
| JP | 2006315746 | A | 11/2006 |
| JP | 05112315 | A | 2/2010 |
| WO | 0164518 | A1 | 9/2001 |

* cited by examiner

Prior Art

AUTOMATIC BANDING PACKING MACHINE AND AUTOMATIC BANDING PACKING SYSTEM

TECHNICAL FIELD

The present invention relates to an automatic banding packing machine and an automatic banding packing system.

BACKGROUND ART

With a trend of labor saving in a packing work, an automatic banding packing machine 100 as shown in FIG. 12 has been widely used as disclosed in Japanese Patent Laid-Open Publication No. H5(1993)-1123153, for example.

That is, the automatic banding packing machine 100 is, as shown in FIG. 12, provided with a packing machine body 101 installed on a floor face of a plant and the like, for example, and on an upper face of the packing machine body 101, an upper-face table 114 constituting a work base for mounting and packing an object to be packed is formed.

And on the upper-face table 114, a band guide arch 102 substantially in the U-shape is installed upright and a continuous band passage is formed therein, though not shown.

That is, the band guide arch 102 is constituted by a pair of vertical arches 104, 106 arranged separately in parallel and an upper arch 108 connecting upper end portions of the vertical arches 104, 106, and the band passage is formed therein.

On the other hand, on the upper-face table 114, a guide groove 110 in a narrow groove state is formed across the substantially center part, and the guide groove 110 communicates with the band passage formed within the band guide arch 102.

In such automatic banding packing machine 100, by setting the object to be packed within a frame of the band guide arch 102, a band is fed out by a band feeding mechanism, not shown, with a subsequent button operation from a reel 112 around which the band is wound to the band passage of the band arch 102 comprising the vertical arches 104, 106 and the upper arch 108 through the guide groove 110, and a series of packing works including band pulling-back, band fastening, and further welding carried out substantially at the same time as cutting are all automatically performed.

In a delivery plant of articles and the like, cross-like banding is performed on an object to be packed in some cases.

In this case, an automatic banding packing system 200 arranged on a conveying line is used with two units of the automatic banding packing machines 100 with the conventional configuration as shown in FIG. 12.

That is, as shown in FIG. 13, on the upstream side of the automatic banding packing system 200, a first automatic banding packing machine 202 for first banding is arranged, and a first conveying line 204 is connected to the first automatic banding packing machine 202.

The first conveying line 204 is constituted by a conveyor and the like, for example, and comprises a first carry-in apparatus 206 connected to a carry-in side of the first automatic banding packing machine 202 and a first carry-out apparatus 208 connected to a carry-out side of the first automatic banding packing machine 202.

And the first automatic banding packing machine 202 is arranged so that a conveying direction of the first conveying line 204, that is, the conveying direction of the first carry-in apparatus 206 and the first carry-out apparatus 208 crosses an arch direction of an upper arch 210 of the first automatic banding packing machine 202 at a right angle.

On the downstream side of the automatic banding packing system 200, a second automatic banding packing machine 212 for subsequent banding is arranged, and a second conveying line 214 is connected to the second automatic banding packing machine 212.

The second conveying line 214 is constituted by a conveyer and the like, for example, and comprises a second carry-in apparatus 216 connected to a carry-in side of the second automatic banding packing machine 212 and a second carry-out apparatus 218 connected to a carry-out side of the second automatic banding packing machine 212.

And the second automatic banding packing machine 212 is arranged so that the conveying direction of the second conveying line 214, that is, the conveying direction of the second carry-in apparatus 216 and the second carry-out apparatus 218 crosses the arch direction of an upper arch 220 of the second automatic banding packing machine 212 at a right angle.

In this automatic banding packing system 200, as shown in FIG. 13, the conveying direction of the first conveying line 204 and the second conveying line 214 are connected so that they cross each other at a right angle.

Therefore, in the automatic banding packing system 200 constituted as above, a packing work is carried out as follows.

First, an object to be packed 224 is sequentially delivered by the first carry-in apparatus 208 of the first conveying line 204 as shown by an arrow in FIG. 13 and carried into the first automatic banding packing machine 202. And at this first automatic banding packing machine 202, first banding is performed in a direction orthogonal to the conveying direction of the first conveying line 204 (See the object to be packed 224 in the lower right of FIG. 13).

Subsequently, through the first carry-out apparatus 208 of the first conveying line 204, the object to be packed 224 on which the first banding has been performed is carried out from the first automatic banding packing machine 202 and transferred onto the second carry-in apparatus 216 of the second conveying line 214 on the downstream side, located on the downstream side of the first conveying line 204 and arranged at a right angle with the first conveying line 204, through a transfer apparatus such as a traverser, not shown.

And at the first automatic banding packing machine 202, the object to be packed 224 on which the first banding has been performed is conveyed over the second carry-in apparatus 216 as shown by an arrow in FIG. 13 and carried into the second automatic banding packing machine 212 performing the subsequent banding in a cross state in a direction orthogonal to the direction of the first banding.

And at the second automatic banding packing machine 212, banding is performed in a direction orthogonal to the conveying direction of the second carry-in apparatus 216 and as shown in the object to be packed 224 in the upper right of FIG. 13, the cross-state banding is performed on the object to be packed 224.

However, with such conventional automatic banding packing system shown in FIG. 13, it is necessary as mentioned above that the first conveying line 204 and the second conveying line 214 orthogonal to each other are provided, and the first automatic banding packing machine 202 for performing the first banding and the second automatic banding packing machine 212 for performing the subsequent banding are provided on the first conveying line 204 and the second conveying line 214, respectively.

That is, as shown in FIG. 13, when two units of the first automatic banding packing machine 202 and the second automatic banding packing machine 212 are used, the first carry-in apparatus 206 and the first carry-out apparatus 208 of the first conveying line 204 constituted by a conveyer and the like should be arranged in a direction orthogonal to the upper arch 210 for the first automatic banding packing machine 202.

Also for the second automatic banding packing machine 212, the second carry-in apparatus 216 and the second carry-out apparatus 218 of the second conveying line 214 should be arranged in a direction orthogonal to the upper arch 220. Moreover, a transfer apparatus such as a traverser is required between the first conveying line 204 and the second conveying line 214.

As mentioned above, in the case of the cross-state banding on the object to be packed 224 in a mode of FIG. 13, since it is necessary to arrange the first conveying line 204 and the second conveying line 214 in directions orthogonal to each other, a large installation space for installing the first conveying line 204 and the second conveying line 214 is needed, a transfer apparatus such as a traverser is separately required, and apparatus configuration becomes complicated, which are problems.

In order to solve such a problem of space, an automatic banding packing system can be configured, as shown in FIG. 14, by aligning the first conveying line 204 and the second conveying line 214 in a straight direction.

However, in this case, as shown in FIG. 14, the upper arch 220 of a band guide arch 222 of the second automatic banding packing machine 212 performing the subsequent banding is arranged in parallel with the conveying direction of the second conveying line 214.

Thus, even if the object to be packed 224 on which the first banding has been performed is to be conveyed over the second carry-in apparatus 216 and carried into the second automatic banding packing machine 212, a vertical arch part of the band guide arch 222 of the second automatic banding packing machine 212 is on the way and the object to be packed 224 can not be carried into the second automatic banding packing machine 212, and the subsequent banding is impossible.

In order to solve the above problem, Japanese Patent Laid-Open Publication No. 2006-290431 ("JP-'431") proposes an automatic banding packing machine configured so that the band guide arch is capable of tilting by 90° with respect to the packing machine body as shown in FIG. 15.

That is, as shown in FIG. 15, in this automatic banding packing machine 300, a band guide arch 302 of the automatic banding packing machine 300 is configured capable of tilting in a direction of an arrow A-A' with respect to an upper-face table 306 of a packing machine body 304 and is usually used in an upright state to the upper-face table 306.

That is, the band guide arch 302 is rotatably supported by a rotating shaft 308 arranged at a position somewhat lower than a top face of the upper-face table 306 and by tilting it in a direction of an arrow A with the rotating shaft 308 as a fulcrum through a tilting driving mechanism, not shown, the entire arch is arranged along the upper face of the upper-face table 306.

And banding is performed when the band guide arch 302 is in a standing attitude in the vertical direction as shown by a solid line in FIG. 15, and it can be tilted in an attitude of lying down by 90° as shown by a virtual line as necessary.

Also, JP-'431 proposes configuration of an automatic banding packing system 320 by using one unit of an automatic banding packing machine 300 with the structure as shown in FIG. 15 and one unit of a usual second automatic banding packing machine 310 with the structure as shown in FIG. 12 mentioned above and by aligning a first conveying line 312, a second conveying line 314, and a third conveying line 316 in a straight direction as shown in FIG. 16.

That is, first, the band guide arch 302 of the first automatic banding packing machine 300 is arranged in the lying down state on the upper-face table 306 as shown by the virtual line in FIGS. 15 and 16. In a state where the band guide arch 302 is arranged in the laying down state, an object to be packed 318 having been conveyed in an arrow direction on the first conveying line 312 does not contact the band guide arch 302 or obstruct feeding.

And by detecting a fact that the object to be packed 318 has been carried into the first automatic banding packing machine 300 and has reached onto the upper-face table 306 by detecting the object to be packed 318 with detecting means such as a photoelectric tube, not shown, for example, the band guide arch 302 is rotated in a direction of an arrow A' by driving means such as a motor or an air cylinder to bring the band guide arch 302 into an upright state.

In a state where the band guide arch 302 is in a usually upright state as above, the first banding is performed in a direction parallel with the conveying direction of the first conveying line 312 (See the object to be packed 318 over the second conveying line 314 in FIG. 16).

Subsequently, at the automatic banding packing machine 300, it is so configured that the object to be packed 318 on which the first banding has been performed is conveyed over the second conveying line 314 and at the second automatic banding packing machine 310, the banding is performed in a direction orthogonal to the second conveying line 314 and the cross-state banding is performed on the object to be packed 318 and the object is carried out by the third conveying line 316 (See the object to be packed 318 on the third conveying line 316 in FIG. 16).

In Japanese Patent Laid-Open Publication No. 2006-315746 ("JP-'746"), as shown in FIG. 17, an automatic banding packing machine 400 with another configuration is proposed, and at this automatic banding packing machine 400, a band guide arch 402 is installed upright with bias to the rear of an upper-face table 404.

And such automatic banding packing machine 400 is proposed in which a center bar 408 capable of tilting is provided at a region below a horizontal arch 406 of the band guide arch 402, and a band pulled back into a packing machine body 410 from the band guide arch 402 is received by the center bar 408 and then, dropped below.

On the other hand, Japanese Patent Laid-Open Publication No. S61(1986)-127410 ("JP-'410") discloses an automatic banding packing machine 500 as shown in FIG. 18.

That is, this automatic banding packing machine 500 uses two arches 504, 506 in a packing machine body 502, in which the inner arch 504 of them is installed upright close to the center of the packing machine body 502 so that a band revolves in the arch for packing, while the other outer arch 506 is arranged so as to cross the inner arch 504 at a right angle.

It is so configured that a vertical arm of the outer arch 506 is located at a position not obstructing ingress of an object to be packed 516 into the packing machine body 502, and the vertical arm of the outer arch 506 is moved to a position for packing after the ingress, the band revolves inside, and the band of the outer arch 506 crosses the band of the inner arch 504 vertically so that the object to be packed 516 can be packed.

However, with the automatic banding packing machine 300 of JP-'431, the configuration of the tilting mechanism for tilting the band guide arch 302 is complicated, the apparatus becomes bigger in consideration of durability and safety, and it takes costs, which are problems.

With the automatic banding packing machine 400 of JP-'746, since the band guide arch 402 is installed upright with bias to the rear of the upper-face table 404, a corner portion is enlarged, and band supply runs short when supplying a band into the band guide arch, which is a problem.

Moreover, with the automatic banding packing machine 500 of JP-'410 in which the inner arch 504 and the other outer arch 506 cross each other at a right angle in the cross state, as shown in FIG. 18, configuration in which a projecting mechanism 508 of the inner arch 504 is fitted with a gap portion 510 of the outer arch 506 is required, and moreover, complicated configuration in which a short and small band guide 514 in the projecting mechanism 508 of the inner arch 504 enters in the middle of a band guide 512 of the outer arch 506 and the band guide 512 and the short and small band guide 514 communicate with each other and make the band capable of revolving in the outer arch 506 is needed, which takes costs.

The present invention was made in view of the circumstances and has an object to provide an automatic banding packing machine and its automatic banding packing system in which conveying lines of an object to be packed can be aligned in a straight direction, an installation space can be small, an entire structure can be simplified, and moreover, band supply into a band guide arch can be performed surely and continuous packing work is possible.

SUMMARY OF THE INVENTION

The present invention was made in order to solve the problems in the related arts and to achieve the objects, and the automatic banding packing machine of the present invention comprises:

a packing machine body having an upper-face table on which an object to be packed passes;

a pair of vertical band guide arches arranged above the upper-face table in a direction parallel with a passage direction of the object to be packed separately from each other; and a horizontal band guide arch arranged above the upper-face table in a direction parallel with the passage direction of the object to be packed, wherein the pair of vertical band guide arches are configured to be movable between a standby position separated from the horizontal band guide arch in a direction orthogonal to the passage direction of the object to be packed and a communication position communicating with the horizontal band guide arch.

With configuration as above, when the object to be packed is to be carried into the automatic banding packing machine, by positioning the pair of vertical band guide arches arranged in the direction parallel with the passage direction of the object to be packed separately from each other at the standby position separated from the horizontal band guide arch in the direction orthogonal to the passage direction of the object to be packed, when the object to be packed is carried into the automatic banding packing machine, the vertical band guide arches do not stand in the way but the object can be surely carried into a packing position of the automatic banding packing machine.

In a state where the object to be packed has been carried into the packing position of the automatic banding packing machine, the pair of vertical band guide arches arranged separately from each other are moved from the standby position to the communication position communicating with the horizontal band guide arch.

As a result, the pair of vertical band guide arches and the horizontal band guide arch form a U-shaped band guide arch, within which a band passage is formed, and by feeding a band so as to have it pass through the band passage, the band can be surely supplied into the band guide arch.

In this state, a series of packing works including pulling-back of the band, fastening of the band, and moreover, welding performed substantially at the same time as cutting are all carried out automatically, whereby the object to be packed can be banded in parallel with the direction where the object to be packed passes through.

Also, the automatic banding packing machine of the present invention is characterized in that the horizontal band guide arch is arranged at an upper side of the vertical band guide arches.

With such configuration, in a state where the pair of vertical band guide arches have been moved from the standby position to the communication position communicating with the horizontal band guide arch, the U-shaped band guide arch is constituted by the pair of vertical band guide arches and the horizontal band guide arch, inside which the band passage is surely formed.

As a result, by feeding the band so that the band is passed through the band passage, a series of packing works including pulling-back of the band, fastening of the band, and moreover, welding substantially at the same time as cutting are all automatically carried out, whereby the object to be packed can be banded in parallel with the direction through which the object to be packed is passed.

Also, the automatic banding packing machine of the present invention is characterized in that the horizontal band guide arch is arranged in a state fixed above the upper-face table.

With such configuration, there is no need to move the horizontal band guide arch, but it is only necessary to move the pair of vertical band guide arches from the standby position to the communication position communicating with the horizontal band guide arch, which simplifies the apparatus configuration and reduces costs.

Also, the automatic banding packing machine of the present invention is characterized in that the horizontal band guide arch is configured capable of moving its position in a direction orthogonal to the passage direction of the object to be packed above the upper-face table.

With such configuration, by moving the horizontal band guide arch to an arbitrary position in a direction orthogonal to the passage direction of the object to be packed above the upper-face table and by moving the pair of vertical band guide arch arranged separately from each other from the standby position to the communication position communicating with the horizontal band guide arch for performing banding, at the arbitrary position in the direction orthogonal to the passage direction of the object to be packed, the object to be packed can be banded in parallel with the direction through which the object to be packed is passed.

Therefore, at plural positions in the direction orthogonal to the passage direction of the object to be packed, banding can be performed in parallel with the passage direction of the object to be packed so as to ensure firmer banding.

Also, the automatic banding packing machine of the present invention is characterized in that the horizontal band guide arch is arranged in plural in the direction orthogonal to the passage direction of the object to be packed.

With such configuration, by moving the pair of vertical band guide arches arranged separately from each other from the standby position to the communication position communicating with the horizontal band guide arches arranged in plural so as to perform banding, respectively, at the arbitrary plural positions in the direction orthogonal to the passage direction of the object to be packed, the object to be packed can be banded in parallel with the passage direction of the object to be packed.

Therefore, at plural positions in the direction orthogonal to the passage direction of the object to be packed, the object to be packed can be banded in parallel with the passage direction of the object to be packed so as to ensure firmer banding.

Also, the automatic banding packing machine of the present invention is provided with:

driving means for moving positions of the pair of vertical band guide arches in a direction orthogonal to the passage direction of the object to be packed, and characterized in that the driving means is configured to move the positions of the pair of vertical band guide arches in the direction orthogonal to the passage direction of the object to be packed through a link mechanism connected to between the cylinder and the pair of vertical band guide arches.

By employing the cylinder and link mechanism as the driving means for moving the positions of the pair of vertical band guide arches in the direction orthogonal to the passage direction of the object to be packed, the pair of vertical band guide arches can be moved to the standby position and the communication position in the direction orthogonal to the passage direction of the object to be packed more surely so as to ensure more accurate banding.

Also, the automatic banding packing machine of the present invention is provided with:

driving means for moving positions of the pair of vertical band guide arches in a direction orthogonal to the passage direction of the object to be packed, and characterized in that the driving means is configured to move the positions of the pair of vertical band guide arches in the direction orthogonal to the passage direction of the object to be packed through a stepping motor.

By employing the stepping motor as the driving means for moving the positions of the pair of vertical band guide arches in the direction orthogonal to the passage direction of the object to be packed as mentioned above, the pair of vertical band guide arches can be moved to the standby position and the communication position in the direction orthogonal to the passage direction of the object to be packed more surely so as to ensure more accurate banding.

Also, the automatic banding packing system of the present invention is an automatic banding packing system for banding an object to be packed in a cross state, in which two automatic banding packing machines are arranged adjacently so that a passage direction of the object to be packed becomes a straight line, one of the automatic banding packing machines is configured by the automatic banding packing machine as described hereinabove, and the other automatic banding packing machine is configured by an automatic banding packing machine for bundling the object to be packed in a direction orthogonal to the passage direction of the object to be packed of the one automatic banding packing machine.

With such configuration, the object to be packed can be banded by the one automatic banding packing machine in parallel with the passage direction of the object to be packed, and the banding and bundling can be performed on the object to be packed by the other banding packing machine in the direction orthogonal to the passage direction of the object to be packed of the one automatic banding packing machine, so that the cross-state banding can be performed on the object to be packed.

Moreover, even if the two automatic banding packing machines are arranged adjacently so that the passage direction of the object to be packed is a straight line, the cross-state banding can be performed, and the automatic banding packing machine and another automatic banding packing machine can be arranged in a straight line state, not in a right angle state as before, which can make an installation space small and moreover, simplify the entire structure.

Also, the automatic banding packing system of the present invention is characterized in that on an upstream side of a conveying line for conveying the object to be packed, one of the automatic banding packing machines is disposed; and on a downstream side of the conveying line for conveying the object to be packed, the other automatic banding packing machine is disposed.

Also, the automatic banding packing system of the present invention is characterized in that on a downstream side of a conveying line for conveying the object to be packed, one of the automatic banding packing machines is disposed; and on an upstream side of the conveying line for conveying the object to be packed, the other automatic banding packing machine is disposed.

As mentioned above, since the one automatic banding packing machine for banding in parallel with the passage direction of the object to be packed and the other banding packing machine for banding the object to be packed in the direction orthogonal to the passage direction of the object to be packed of the one automatic banding packing machine can be freely arranged on the upstream side or the downstream side, freedom of design is improved.

Also, the automatic banding packing system of the present invention is characterized in that the other automatic banding packing machine is constituted by the automatic banding packing machine described in any of the preceding.

With such configuration, by constituting not only the one automatic banding packing machine but also the other automatic banding packing machine by the automatic banding packing machine of the present invention, there is no need to perform the packing work by arranging an automatic banding packing machine with a different structure as before, and its control system does not become complicated but the control system itself is simplified.

According to the present invention, when an object to be packed is to be carried into an automatic banding packing machine, by positioning a pair of vertical band guide arches arranged separately from each other in a direction parallel with a passage direction of the object to be packed at a standby position separated from a horizontal band guide arch in a direction orthogonal to the passage direction of the object to be packed, the vertical band guide arches do not stand in the way when the object to be packed is carried into the automatic banding packing machine but can be surely carried into a packing position of the automatic banding packing machine.

And in a state where the object to be packed has been carried into the packing position of the automatic banding packing machine, the pair of vertical band guide arches arranged separately from each other are moved from the standby position to the communication position communicating with the horizontal band guide arch.

As a result, the pair of vertical band guide arches and the horizontal band guide arch form a U-shaped band guide arch, in which a band passage is surely formed, and by feeding a band so as to have it pass through the band passage, band supply into the band guide arch can be performed surely.

And in this state, a series of packing works including pulling-back of the band, fastening of the band and moreover, welding substantially at the same time as cutting and the like are all carried out automatically, whereby the object to be packed can be banded in parallel with the passage direction of the object to be packed.

Also, according to the present invention, there is no need to move the horizontal band guide arch but it is only necessary to move the pair of vertical band guide arches from the standby position to the communication position communicating with the horizontal band guide arch, and the apparatus configuration is simplified and costs can be reduced.

Also, according to the present invention, by moving the horizontal band guide arch to an arbitrary position in the direction orthogonal to the passage direction of the object to be packed above the upper-face table and by moving the pair of vertical band guide arches arranged separately from each other from the standby position to the communication position communicating with the horizontal band guide arch for performing banding, at an arbitrary position in the direction orthogonal to the passage direction of the object to be packed, the object to be packed can be banded in parallel with the passage direction of the object to be packed.

Therefore, the object to be packed can be banded in parallel with the passage direction of the object to be packed at plural positions in the direction orthogonal to the passage direction of the object to be packed, which ensures firmer banding.

Also, according to the present invention, by moving the pair of vertical band guide arches arranged separately from each other from the standby position to the communication position communicating with these horizontal band guide arches arranged in plural for performing banding, respectively, the object to be packed can be banded in parallel with the passage direction of the object to be packed at arbitrary plural positions in the direction orthogonal to the passage direction of the object to be packed.

Therefore, at plural positions in the direction orthogonal to the passage direction of the object to be packed, the object to be packed can be banded in parallel with the passage direction of the object to be packed, which can realize firmer banding.

Also, according to the present invention, by employing the cylinder, the link mechanism, and the stepping motor as the deriving means for moving the positions of the pair of vertical band guide arches in the direction orthogonal to the passage direction of the object to be packed, the pair of vertical band guide arches can be moved to the standby position and the communication position in the direction orthogonal to the passage direction of the object to be packed more surely, which ensures accurate banding.

Also, according to the present invention, by the one automatic banding packing machine, the object to be packed can be banded in parallel with the passage direction of the object to be packed and by the other automatic banding packing machine, the object to be packed can be banded and bundled in the direction orthogonal to the passage direction of the object to be packed of the one automatic banding packing machine, and the object to be packed can be banded in the cross state.

Moreover, even if the two automatic banding packing machines are arranged adjacently so that the passage direction of the object to be packed becomes a straight line, the cross-state banding is possible and the automatic banding packing machine and another automatic banding packing machine can be arranged in the straight state, not in the right angle state as before, which reduces the installation space and moreover, simplifies the entire structure.

Also, according to the present invention, since the one automatic banding packing machine for banding in parallel with the passage direction of the object to be packed and the other automatic banding packing machine for banding the object to be packed in the direction orthogonal to the passage direction of the object to be packed of the one automatic banding packing machine can be freely arranged on the upstream side or the downstream side, design freedom is improved.

Also, according to the present invention, by constituting not only the one automatic banding packing machine but also the other automatic banding packing machine by the automatic banding packing machine of the present invention, since there in no need to arrange the automatic banding packing machine with a different structure for performing the packing work as before, the control system does not become complicated but the control system itself is simplified.

BEST MODE FOR CARRYING OUT THE INVENTION

An embodiment (example) of the present invention will be described below in more detail based on the attached drawings.

Figure 1:
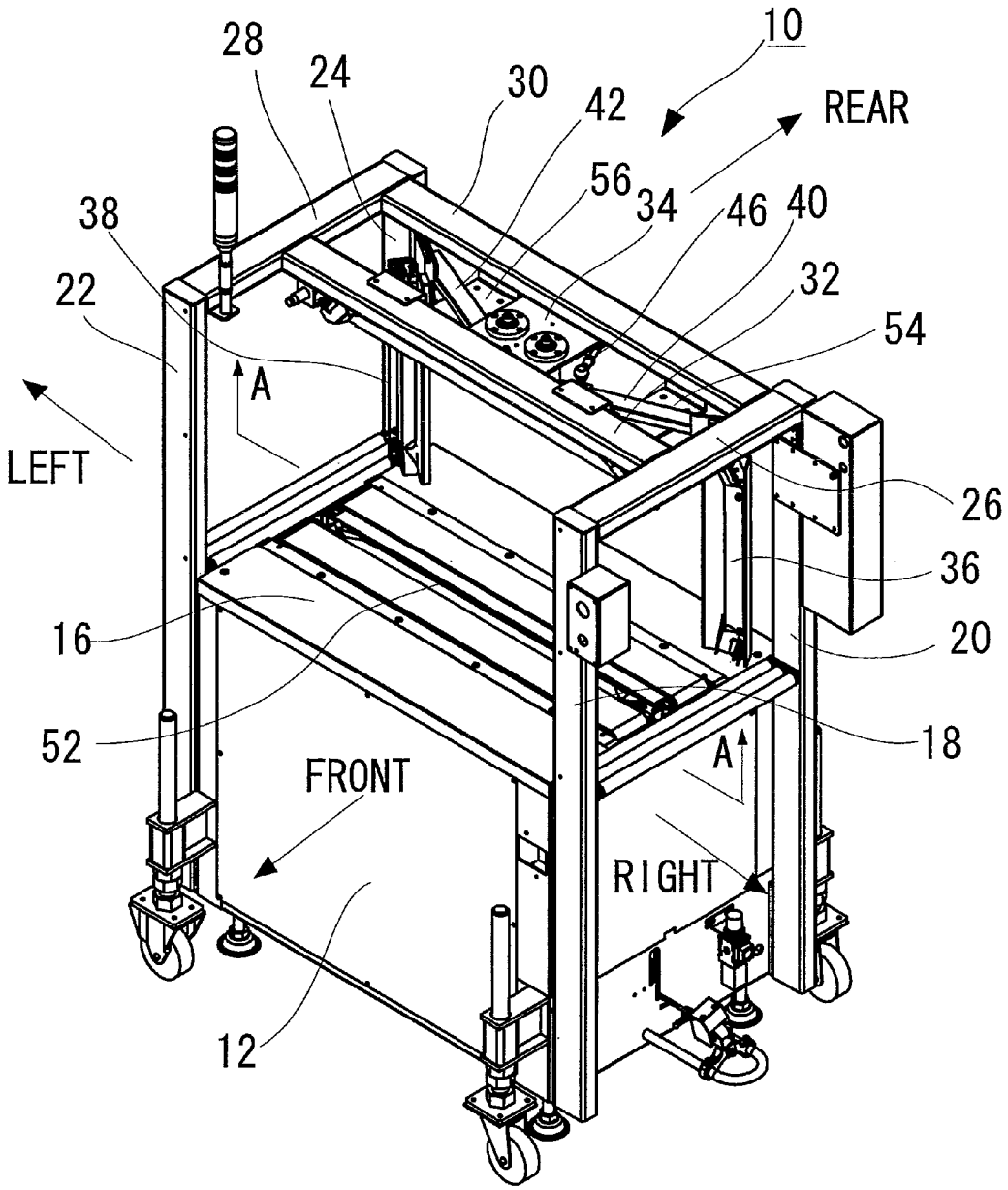
FIG. 1 is a perspective view illustrating a state where a vertical band guide arch of an automatic banding packing machine of the present invention is located at a standby position.
Figure 2:
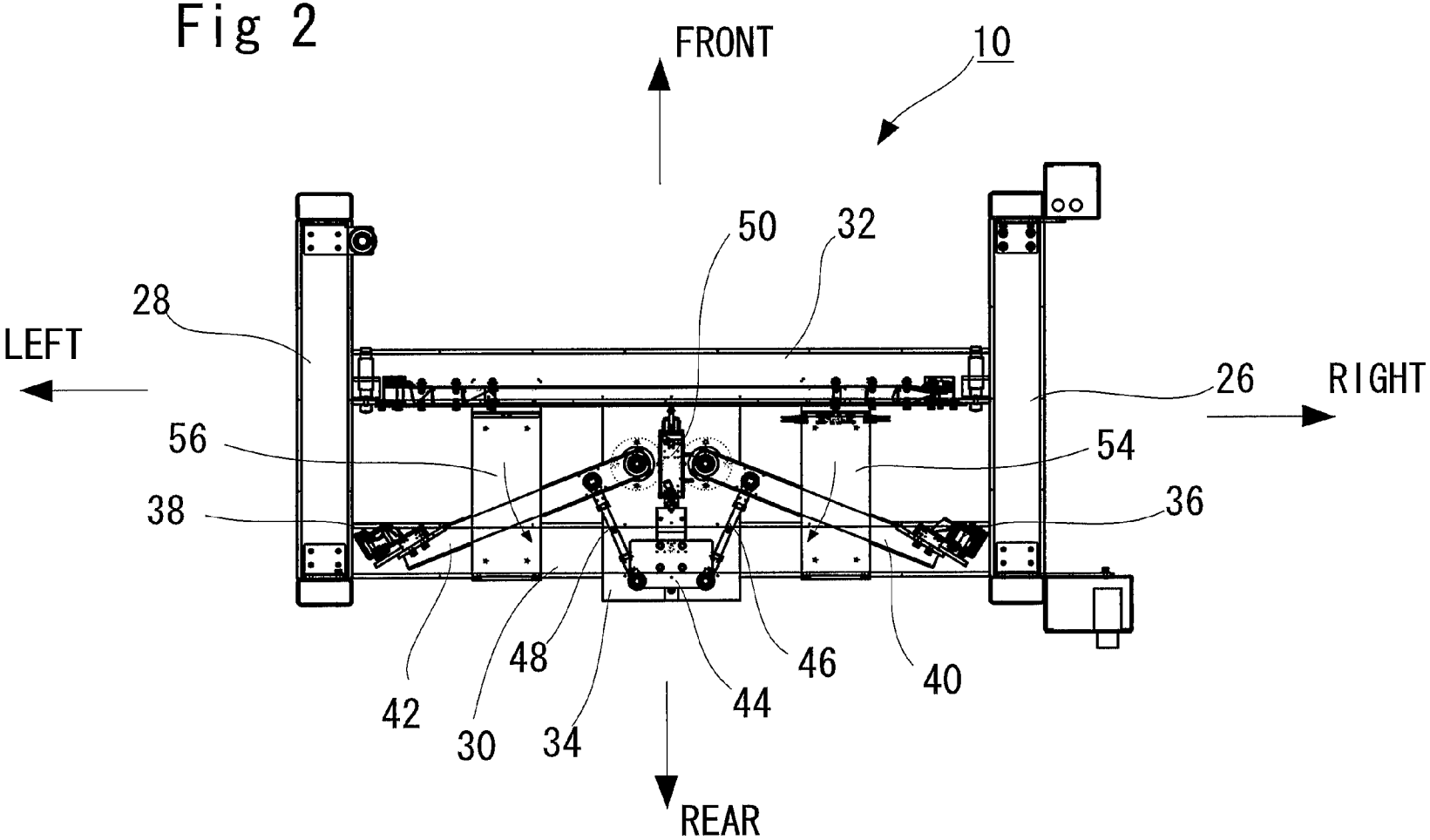
FIG. 2 is a rear view seen from A-A direction in FIG. 1.
Figure 3:
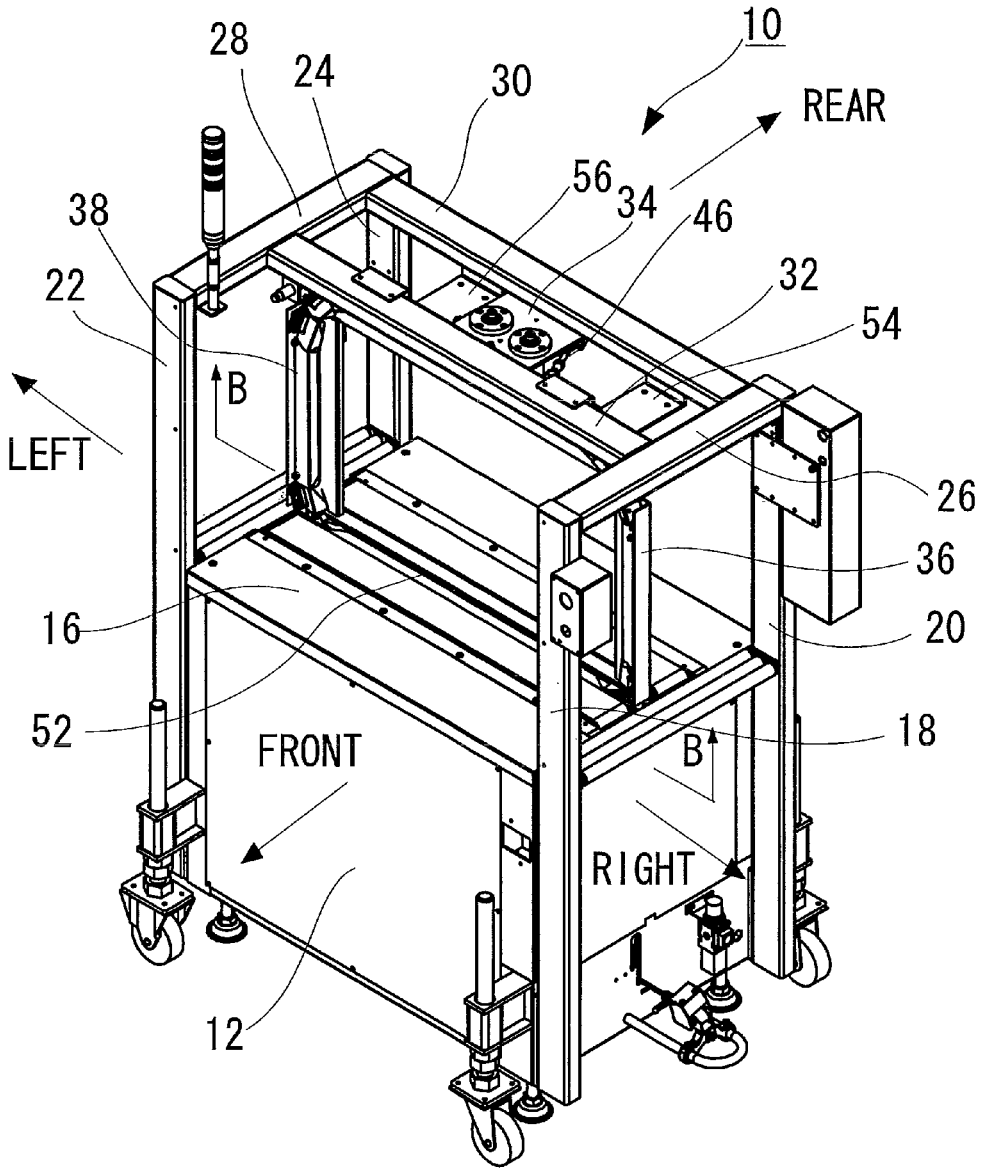
FIG. 3 is a perspective view illustrating a state where it is located at a communication position of the automatic banding packing machine of the present invention.
Figure 4:
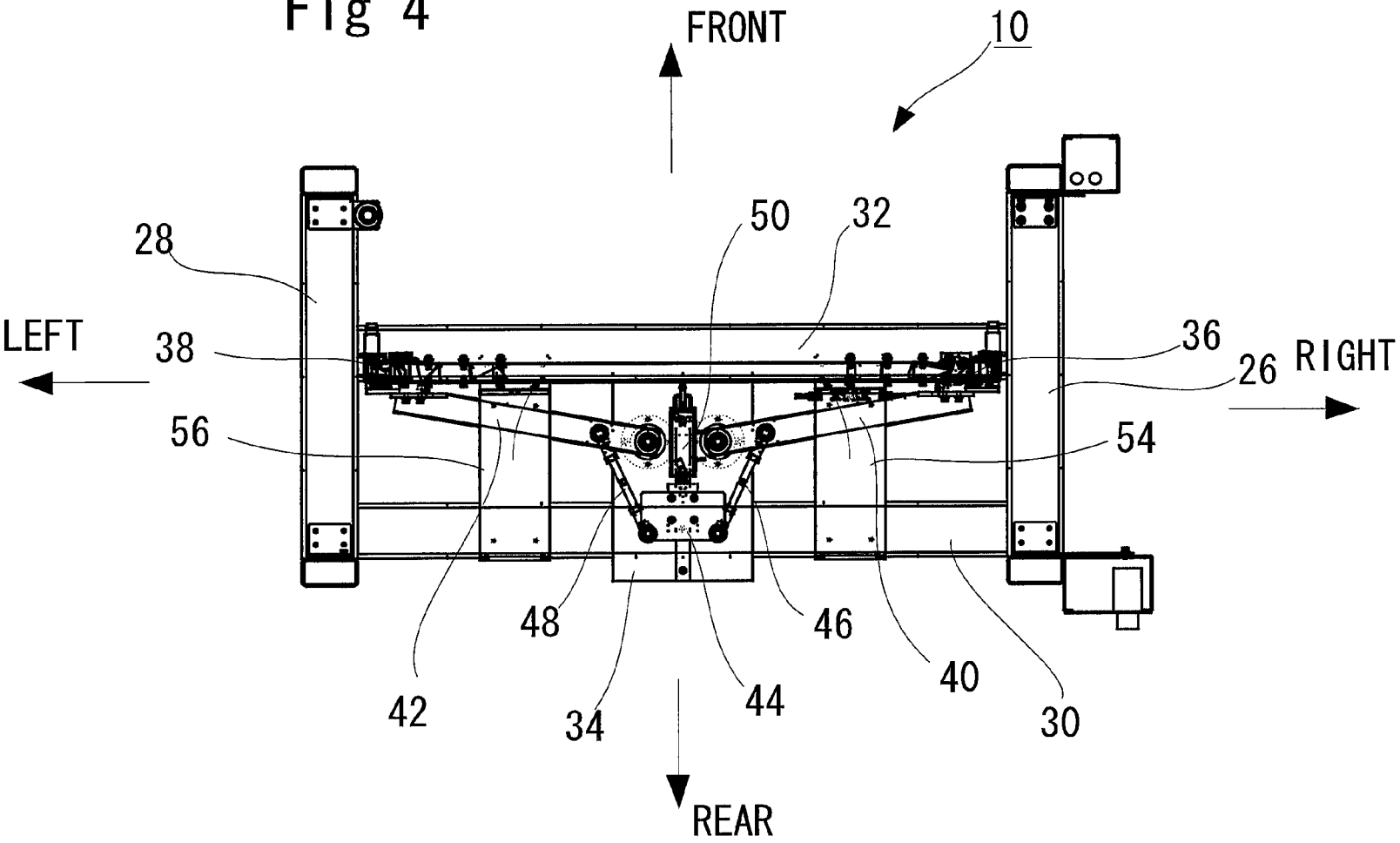
FIG. 4 is a rear view seen from B-B direction in FIG. 3.

FIG. 1 is a perspective view illustrating a state where the vertical band guide arch of the automatic banding packing machine of the present invention is located at a standby position, FIG. 2 is a rear view seen from A-A direction in FIG. 1, FIG. 3 is a perspective view illustrating a state where it is located at a communication position of the automatic banding packing machine of the present invention, and FIG. 4 is a rear view seen from B-B direction in FIG. 3.

In FIG. 1, reference numeral 10 denotes an automatic banding packing machine of the present invention in its entirety.

As shown in FIG. 1, the automatic banding packing machine 10 is provided with a packing machine body 12 installed on a floor face of a plant, for example, and on an upper face of the packing machine body 12, an upper-face table 16 constituting a work base for mounting an object to be packed for packing is formed.

That is, the packing machine body 12 is formed in a box shape and contains a band (not shown) and the like inside, and the packing machine body 12 has its upper face made as the upper-face table 16 on which the object to be packed is passed right and left in FIG. 1.

Also, in FIG. 1, lower parts of frames 18, 20, 22, 24 are mounted at front, rear, right and left four corners of the packing machine body 12.

Moreover, between an upper end of the right-side front frame 18 and an upper end of the right-side rear frame 20, a right-side connection bar 26 is mounted. Similarly, between an upper end of the left-side front frame 22 and an upper end of a left-side rear frame 24, a left-side connection bar 28 is mounted, respectively.

Also, between a rear end of a right-side connection bar 26 and a rear end of a left-side connection bar 28, a rear connection bar 30 is mounted.

And between the right-side connection bar 26 and the left-side connection bar 28, a horizontal band guide arch 32 is arranged above the upper-face table 16 so as to extend in a direction parallel with a passage direction of the object to be packed (right and left direction in FIG. 1).

Also, between a longitudinal intermediate portion of the rear connection bar 30 and a longitudinal intermediate portion of the horizontal band guide arch 32, as shown in FIGS. 1 and 2, a rectangular support plate 34 is mounted.

And above the upper-face table 16, in the direction parallel with the passage direction of the object to be packed, a pair of vertical band guide arches 36, 38 arranged separately from each other are arranged.

Also, the horizontal band guide arch 32 is arranged above the vertical band guide arches 36, 38 and in parallel with the passage direction of the object to be packed.

As shown in FIGS. 2 and 4, at the support plate 34, a left end side of a right-side rotating bar 40 is rotatably pin-connected, and at a right end side of the right-side rotating bar 40, an upper end of the right-side vertical band guide arch 36 is fixed.

Similarly, at the support plate 34, a right end side of a left-side rotating bar 42 is rotatably pin-connected, and at a left end side of the left-side rotating bar 42, an upper end of the left-side vertical band guide arch 38 is fixed.

The right-side vertical band guide arch 36 is suspended from the right-side rotating bar 40 and extends to the vicinity of the upper-face table 16 of the packing machine body 12 through a slight gap. Similarly, the left-side vertical band guide arch 38 is suspended from the left-side rotating bar 42 and extends to the vicinity of the upper-face table 16 of the packing machine body 12 through a slight gap.

By this arrangement, the vertical band guide arches 36, 38 are disposed separately from each other in the direction parallel with the passage direction of the object to be packed and also is made movable in the direction orthogonal to the passage direction of the object to be packed (front and rear direction in FIG. 1) (See FIGS. 1 to 4).

As shown in FIGS. 2 and 4, on a lower face of the support plate 34, a slide plate 44 is provided slidably in the front and rear direction. Between the slide plate 44 and the right-side rotating bar 40, a right-side link 46 is mounted by pin-connection. Also, between the slide plate 44 and the left-side rotating bar 42, a left-side link 48 is mounted by pin-connection.

And on the lower face of the support plate 34, a cylinder device 50 constituting a driving mechanism is fixed, and a distal end portion of a piston of this cylinder device 50 is fixed to the slide plate 44.

Therefore, in the automatic banding packing machine 10, when the object to be packed is to be carried in/carried out, as shown in FIG. 2, it is only necessary to extend the piston of the cylinder device 50. That is, in this case, the slide plate 44 is slid rearward and at the same time, the right-side rotating bar 40 and the left-side rotating bar 42 are rotated in an arrow direction in FIG. 2.

As a result, the right-side vertical band guide arch 36 integrated with the right-side rotating bar 40 is moved to the standby position retreated to a position close to the right-side rear frame 20, and the left-side vertical band guide arch 38 integrated with the left-side rotating bar 42 is moved to the standby position retreated to a position close to the left-side rear frame 24.

Therefore, in the automatic banding packing machine 10, when the object to be packed is to be carried in/carried out, the vertical band guide arches 36, 38 do not stand in the way of carrying-in/carrying-out of the object to be packed.

On the other hand, in the automatic banding packing machine 10, in a state where the object to be packed has been carried in and located at a packing position, it is only necessary to contract the piston of the cylinder device 50. That is, in this case, the slide plate 44 is slid forward and the right-side rotating bar 40 and the left-side rotating bar 42 are rotated in an arrow direction in FIG. 4.

As a result, the right-side vertical band guide arch 36 integrated with the right-side rotating bar 40 is moved to the communication position communicating with the horizontal band guide arch 32 and a narrow groove 52 formed on the upper-face table 16 of the packing machine body 12.

Similarly, the left-side vertical band guide arch 38 integrated with the left-side rotating bar 42 is moved to the communication position communicating with the horizontal band guide arch 32 and the narrow groove 52 formed on the upper-face table 16 of the packing machine body 12.

As a result, the pair of right-side vertical band guide arch 36 and the left-side vertical band guide arch 38 and the horizontal band guide arch 32 form a U-shaped band guide arch, inside which a band passage is formed, and by feeding a band so as to have it pass through the band passage, band can be supplied surely into the band guide arch.

And in this state, a series of packing works including pulling-back of the band, fastening of the band, and moreover, welding performed substantially at the same time as cutting are all carried out automatically, whereby the object to be packed can be banded in parallel with the passage direction of the object to be packed.

Between the rear connection bar 30 and the horizontal band guide arch 32, reinforcement plates 54, 56 are mounted separately on both right and left sides.

Figure 5:
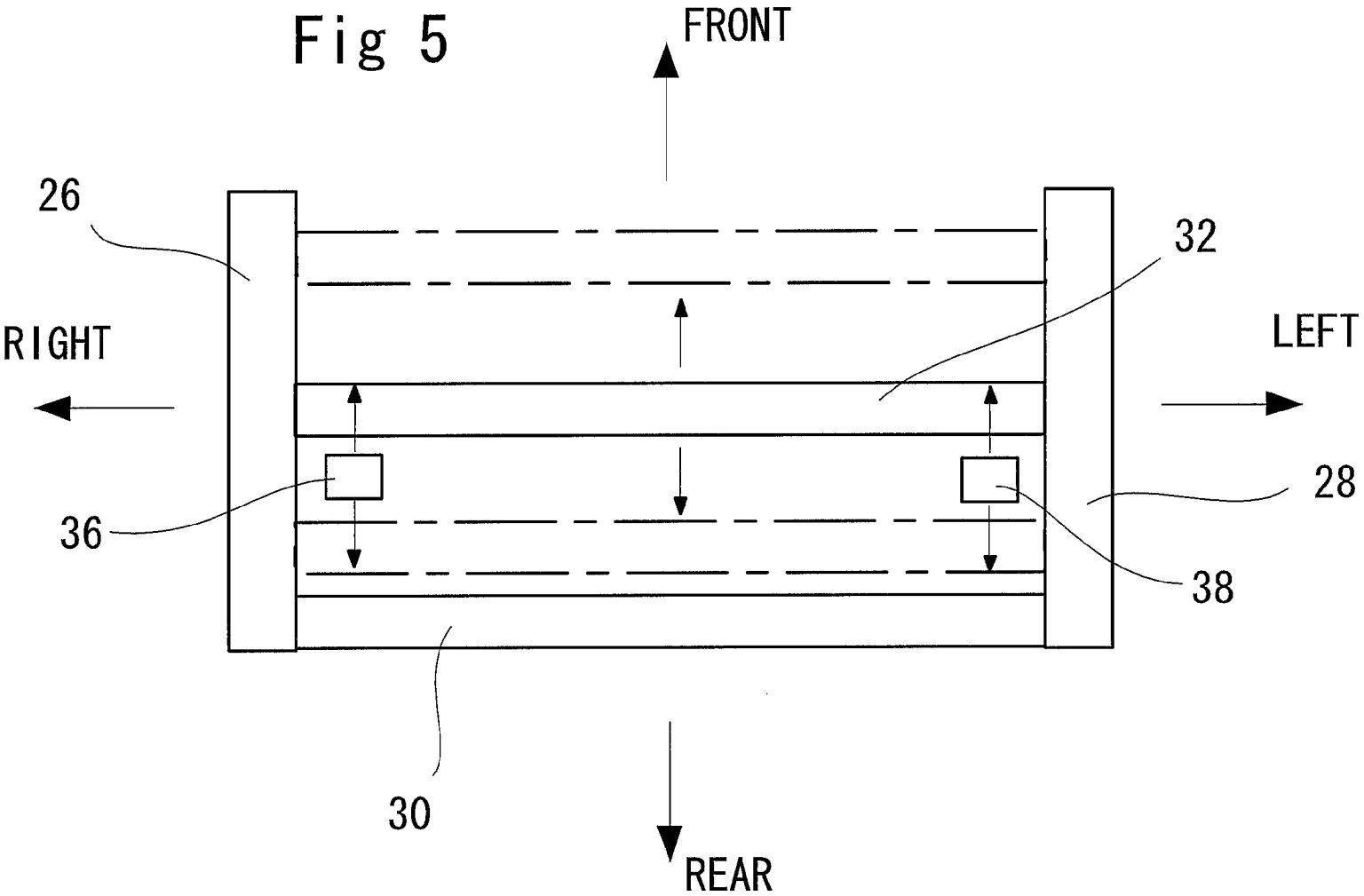
FIG. 5 is an outline top view illustrating another embodiment of the automatic banding packing machine of the present invention.

In the above embodiment, the horizontal band guide arch 32 is arranged in a fixed state above the upper-face table 16, but as shown by an arrow in FIG. 5, the horizontal band guide arch 32 may be constituted movably in the direction orthogonal to the passage direction of the object to be packed above the upper-face table 16.

With such configuration, by moving the horizontal band guide arch 32 above the upper-face table 16 to an arbitrary position in the direction orthogonal to the passage direction of the object to be packed, by moving the pair of vertical band guide arches 36, 38 arranged separately from each other from the standby position to the communication position communicating with the horizontal band guide arch 32 for performing banding, the object to be packed can be banded in parallel with the passage direction of the object to be packed at the arbitrary position in the direction orthogonal to the passage direction of the object to be packed.

Therefore, at plural positions in the direction orthogonal to the passage direction of the object to be packed, banding can be performed in parallel with the passage direction of the object to be packed, and firmer banding can be realized.

Figure 6:
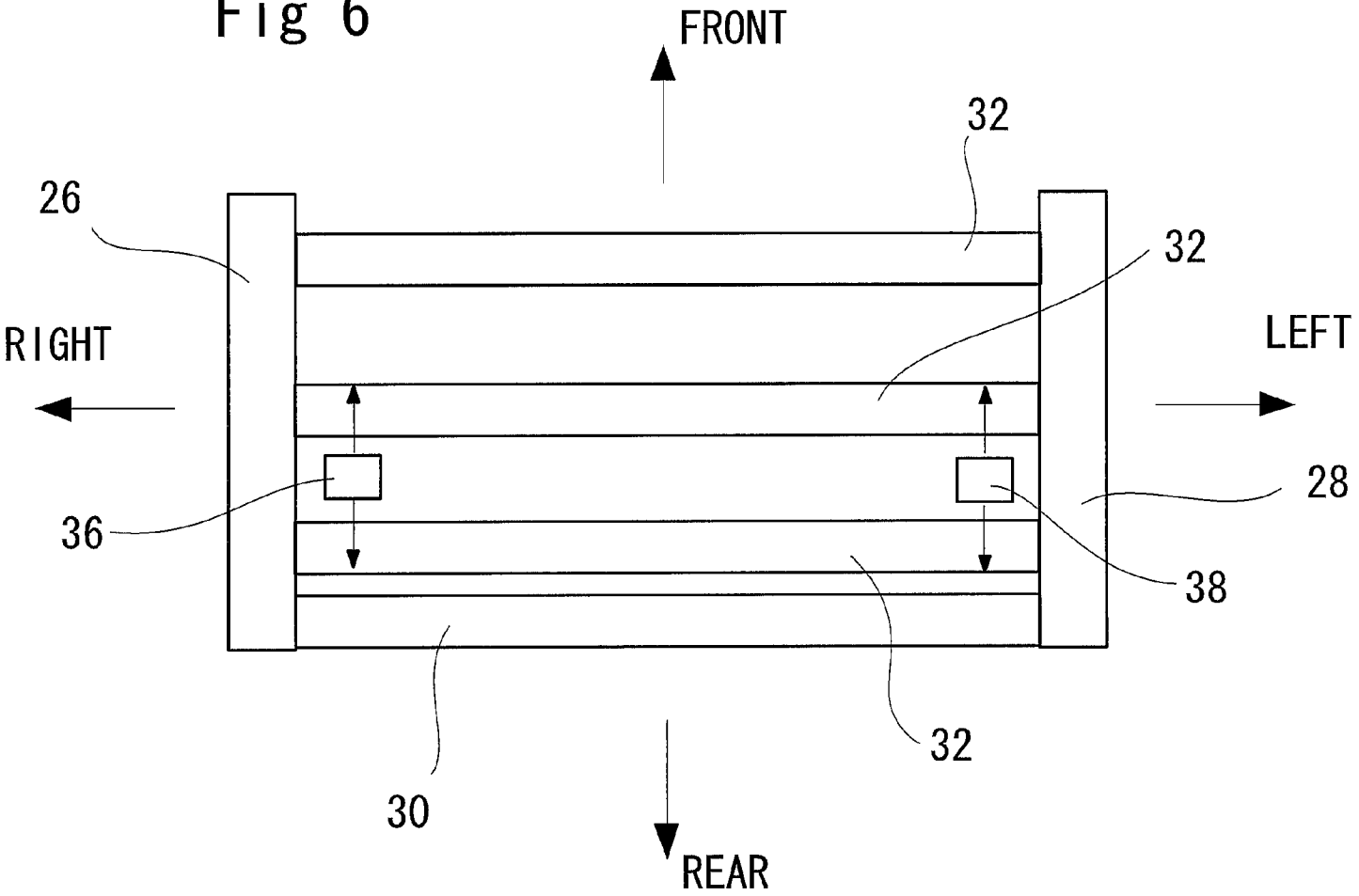
FIG. 6 is an outline top view illustrating another embodiment of the automatic banding packing machine of the present invention.

Also, as shown in FIG. 6, the horizontal band guide arch 32 may be arranged in plural in the direction orthogonal to the passage direction of the object to be packed.

With such configuration, by moving the pair of vertical band guide arches 36, 38 arranged separately from each other from the standby position to the communication position communicating with the horizontal band guide arches 32 arranged in plural for performing banding, respectively, at arbitrary plural positions in the direction orthogonal to the passage direction of the object to be packed, the object to be packed can be banded in parallel with the passage direction of the object to be packed.

Therefore, at the plural positions in the direction orthogonal to the passage direction of the object to be packed, the object to be packed can be banded in parallel with the passage direction of the object to be packed, which enables firmer banding.

Figure 7:
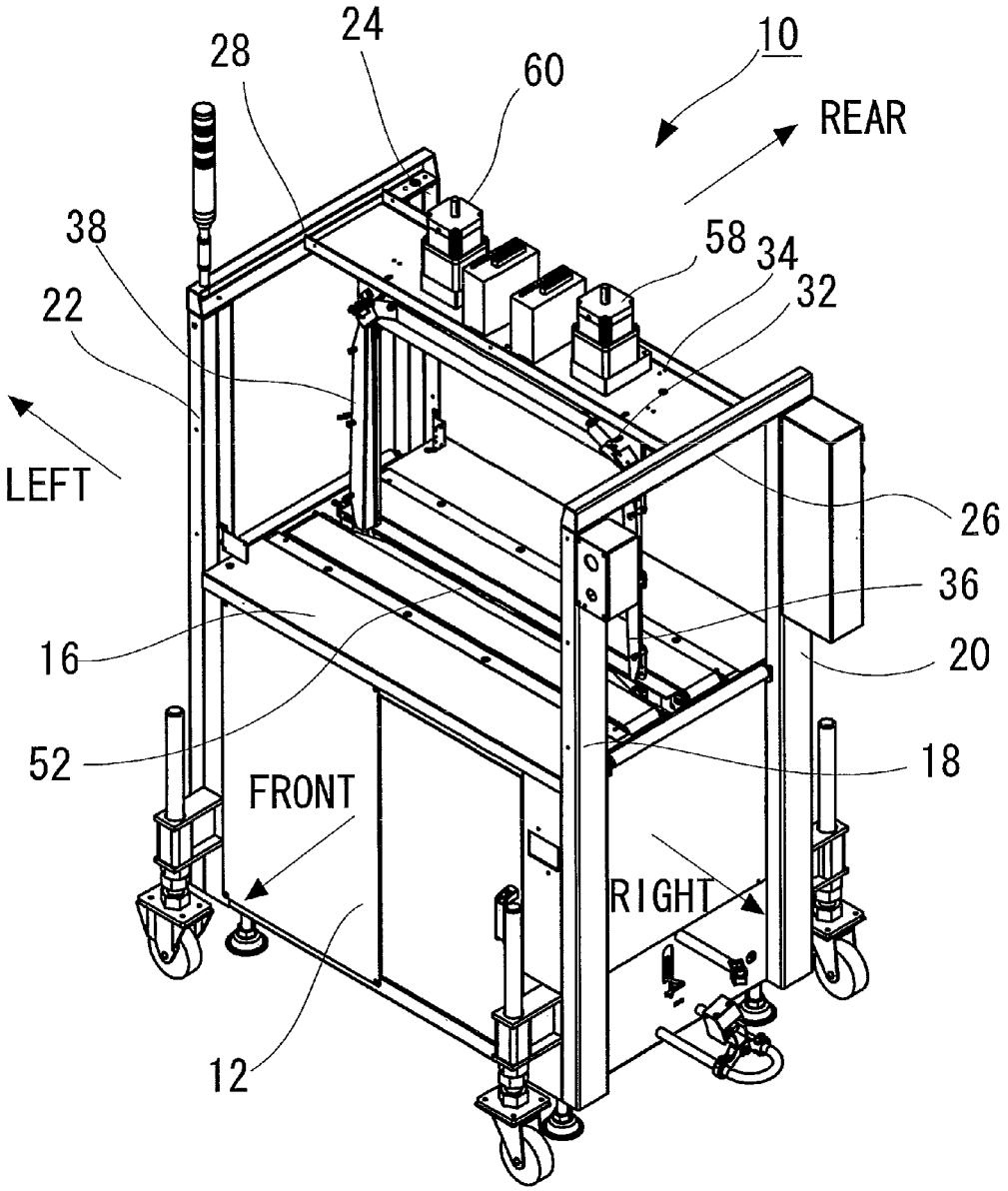
FIG. 7 is a perspective view illustrating another embodiment of the automatic banding packing machine of the present invention.
Figure 8:
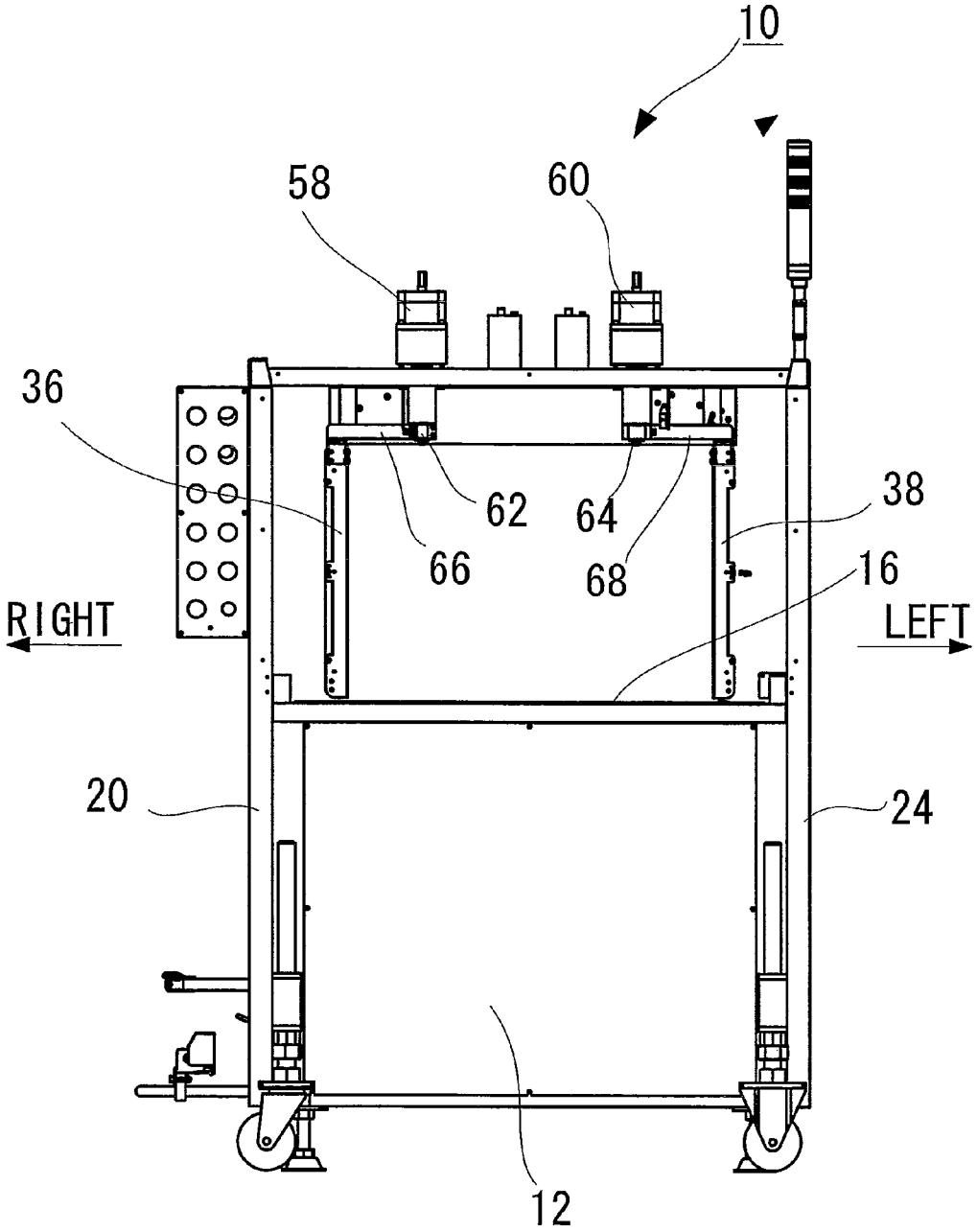
FIG. 8 is a rear view of the automatic banding packing machine in FIG. 7.

Moreover, the above embodiment is configured so that the positions of the pair of vertical band guide arches 36, 38 are moved in the direction orthogonal to the passage direction of the object to be packed through the link mechanism connected between the cylinder device 50 and the pair of vertical band guide arches 36, 38 by extension of the cylinder device 50, but as shown in FIGS. 7 and 8, it may be so configured that by employing stepping motors 58, 60 as driving means and by rotating the rotating bars 66, 68 connected to the rotating shafts 62, 64 of the stepping motors 58, 60, respectively, the positions of the pair of vertical band guide arches 36, 38 are moved in the direction orthogonal to the passage direction of the object to be packed.

By employing the stepping motors 58, 60 as the driving means for moving the positions of the pair of vertical band guide arches 36, 38 in the direction orthogonal to the passage direction of the object to be packed as above, the pair of vertical band guide arches 36, 38 can be moved to the standby position and the communication position in the direction orthogonal to the passage direction of the object to be packed more surely, which ensures more accurate banding.

Figure 9:
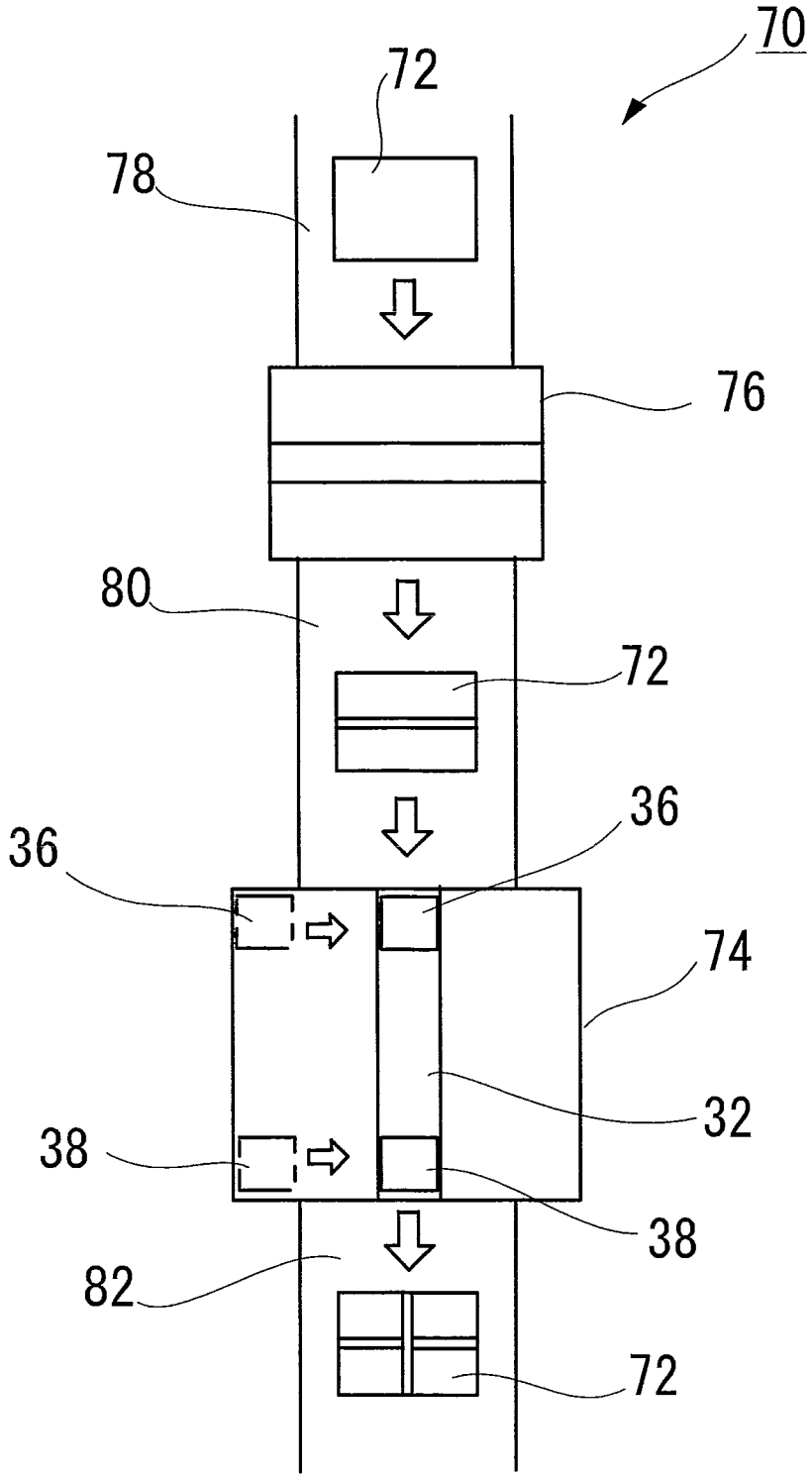
FIG. 9 is an outline plan view illustrating an embodiment of an automatic banding packing system 70 using an automatic banding packing machine 10 of the present invention.

FIG. 9 is an outline plan view illustrating an embodiment of an automatic banding packing system 70 using the automatic banding packing machine 10 of the present invention.

As shown in FIG. 9, in the automatic banding packing system 70, the two automatic banding packing machines are arranged adjacently so that the passage direction of an object to be packed 72 becomes a straight line.

That is, in the automatic banding packing system 70 of this embodiment, a one automatic banding packing machine 74 comprising the automatic banding packing machine 10 of the present invention for banding on the object to be packed 72 in parallel with the passage direction of the object to be packed 72 is arranged on the downstream side.

Figure 12:
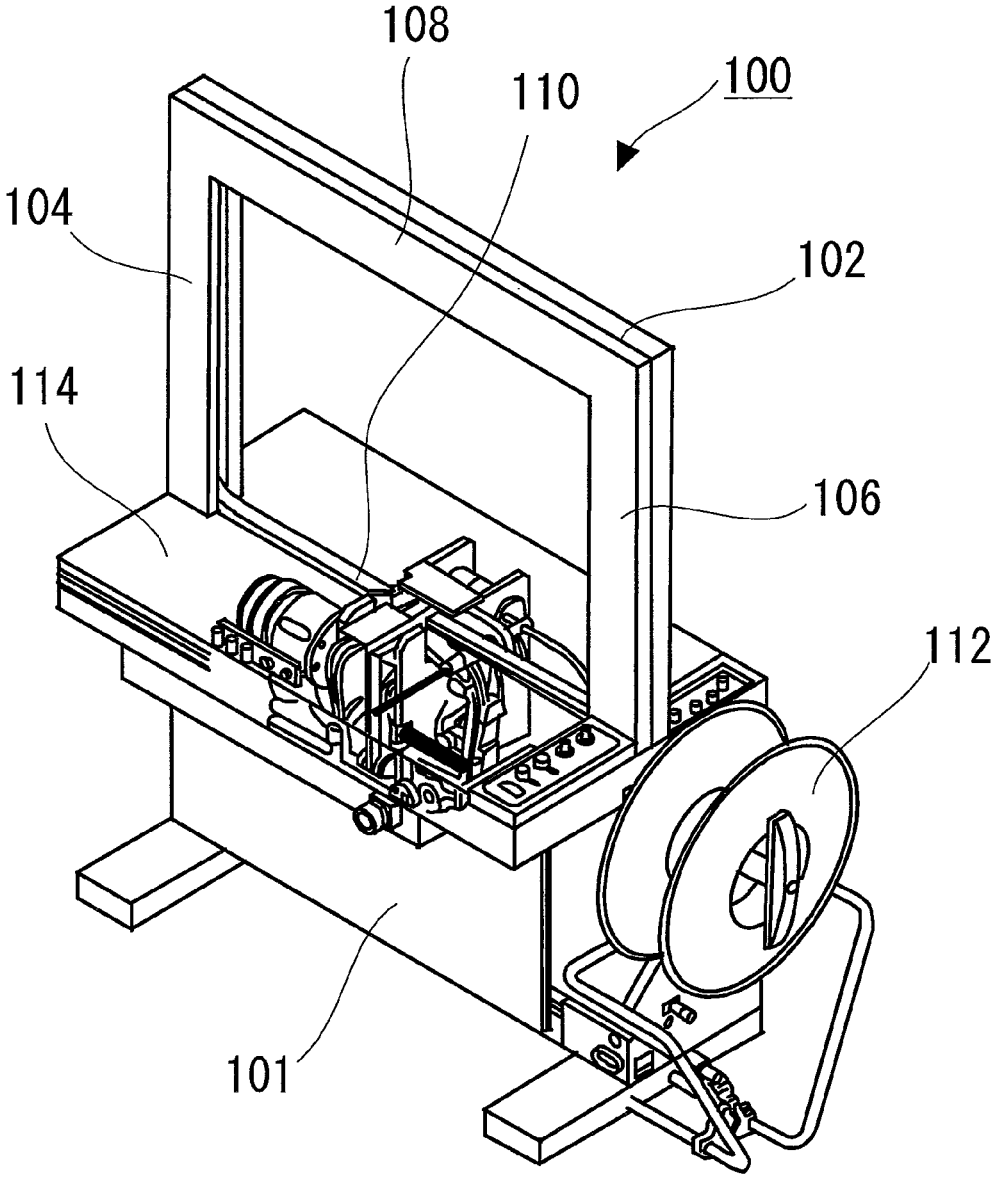
FIG. 12 is an outline perspective view of a conventional automatic banding packing machine.
Figure 13:
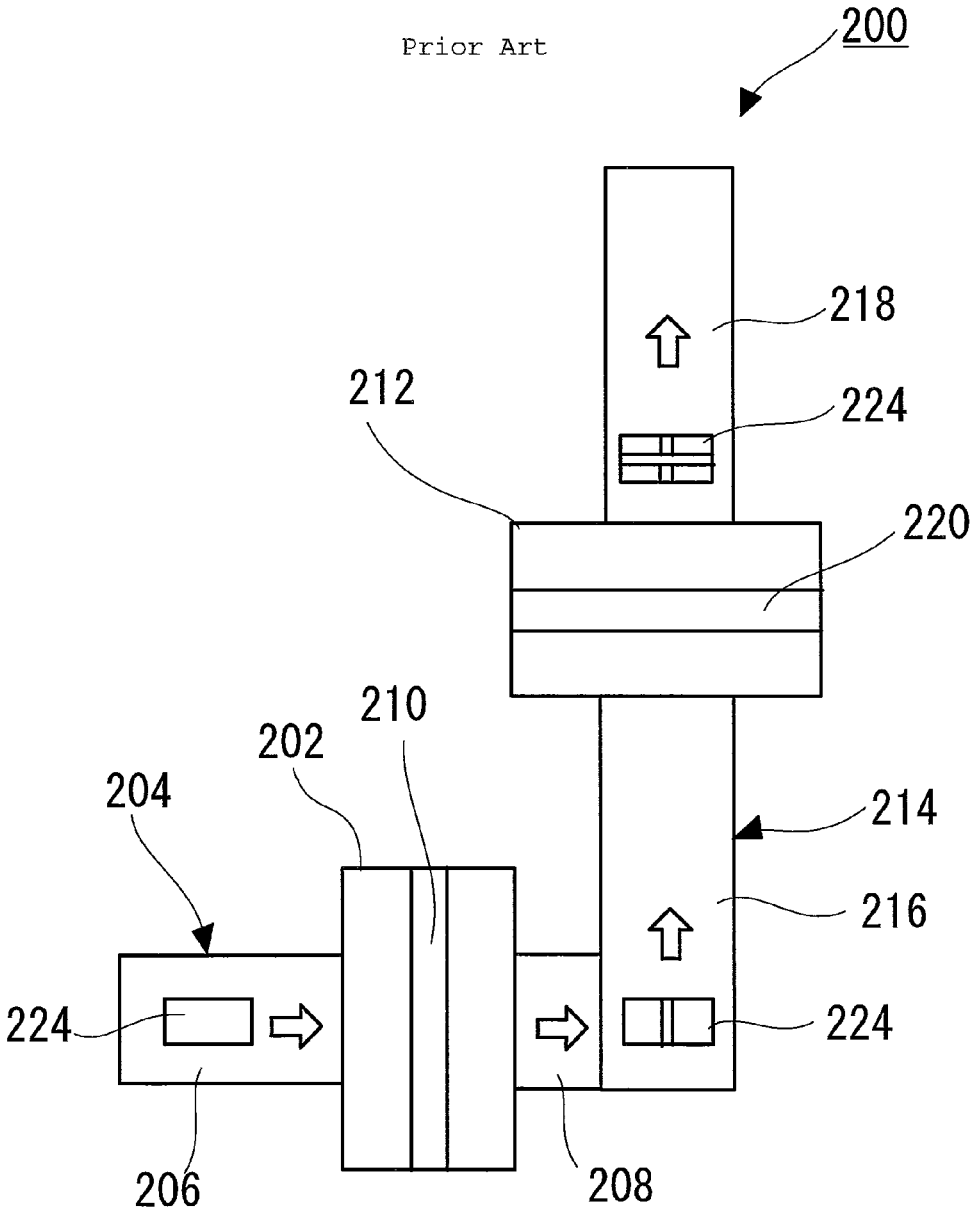
Fig 13 Prior Art
FIG. 13 is a plan view illustrating a disposed situation of a conveying line for cross banding on an object to be packed using the conventional automatic banding packing machine and the automatic banding packing machines.
Figure 14:
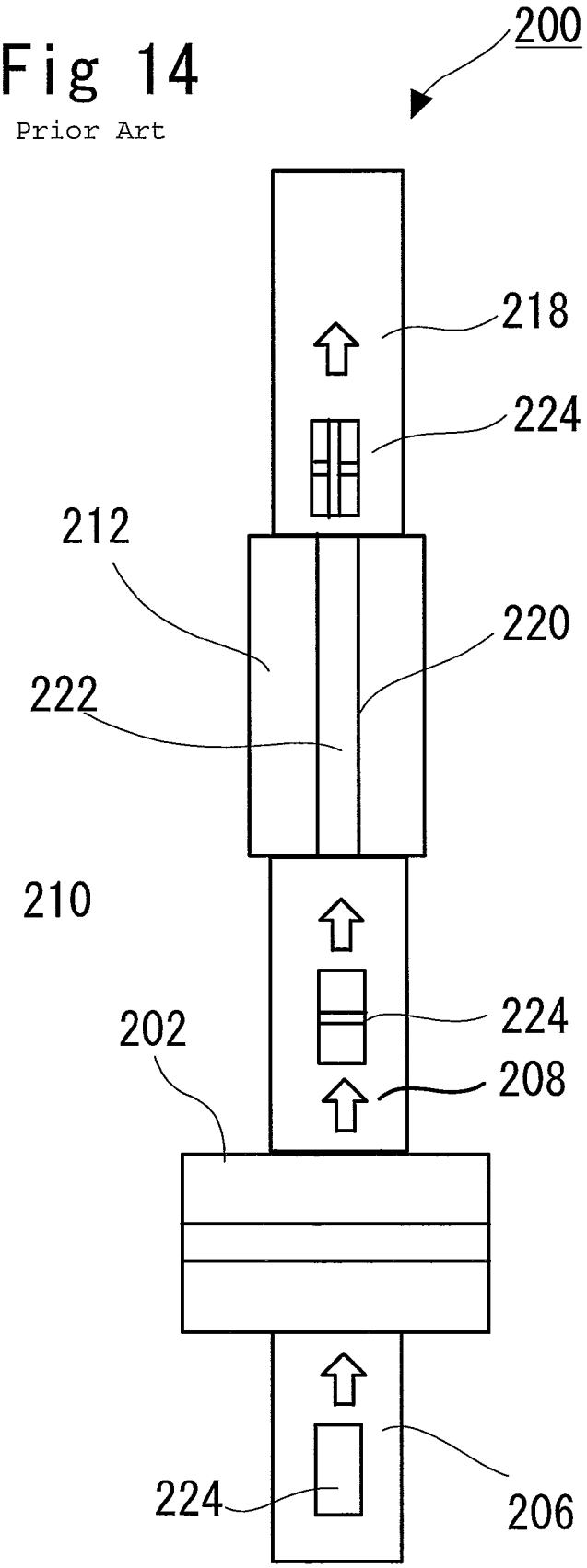
Fig 14 Prior Art
FIG. 14 is a plan view for explaining nonconformity when the conventional automatic banding packing machines are arranged in a straight line for cross banding on the object to be packed.
Figure 15:
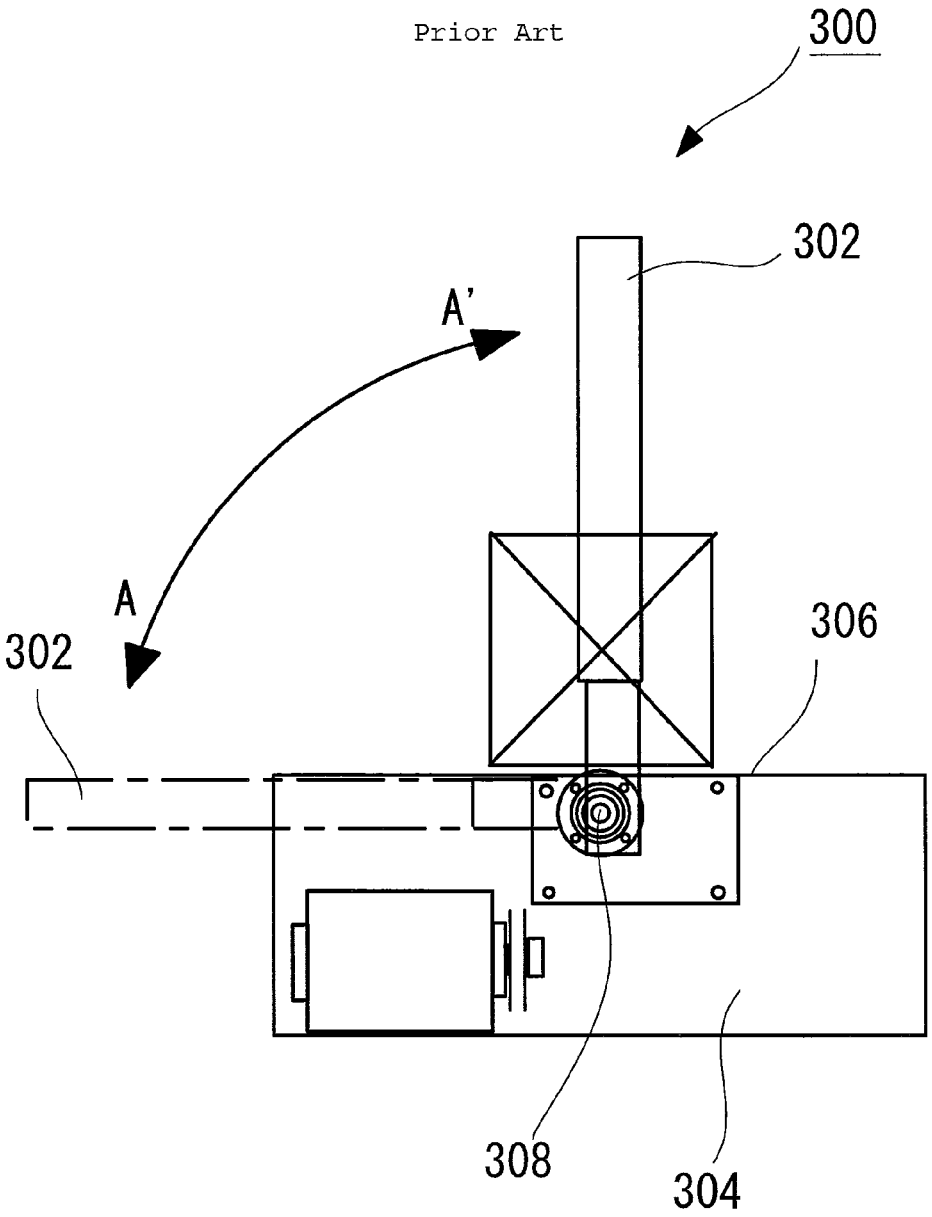
Fig 15 Prior Art
FIG. 15 is a partially enlarged side view of the conventional automatic banding packing machine.
Figure 16:
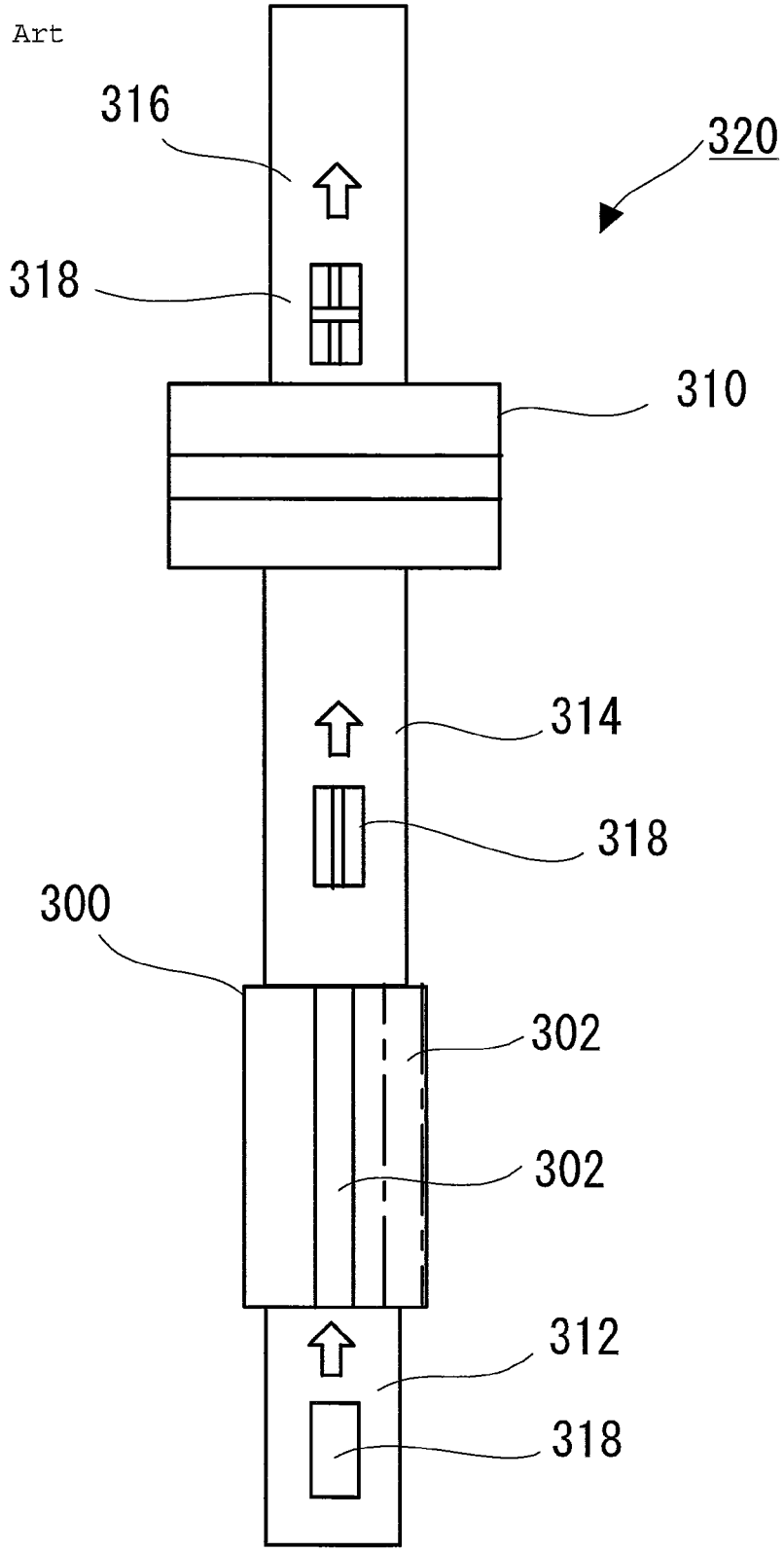
Fig 16 Prior Art
FIG. 16 is a plan view illustrating a disposed situation of a conveying line for cross banding on an object to be packed using the conventional automatic banding packing machine and the automatic banding packing machines.
Figure 17:
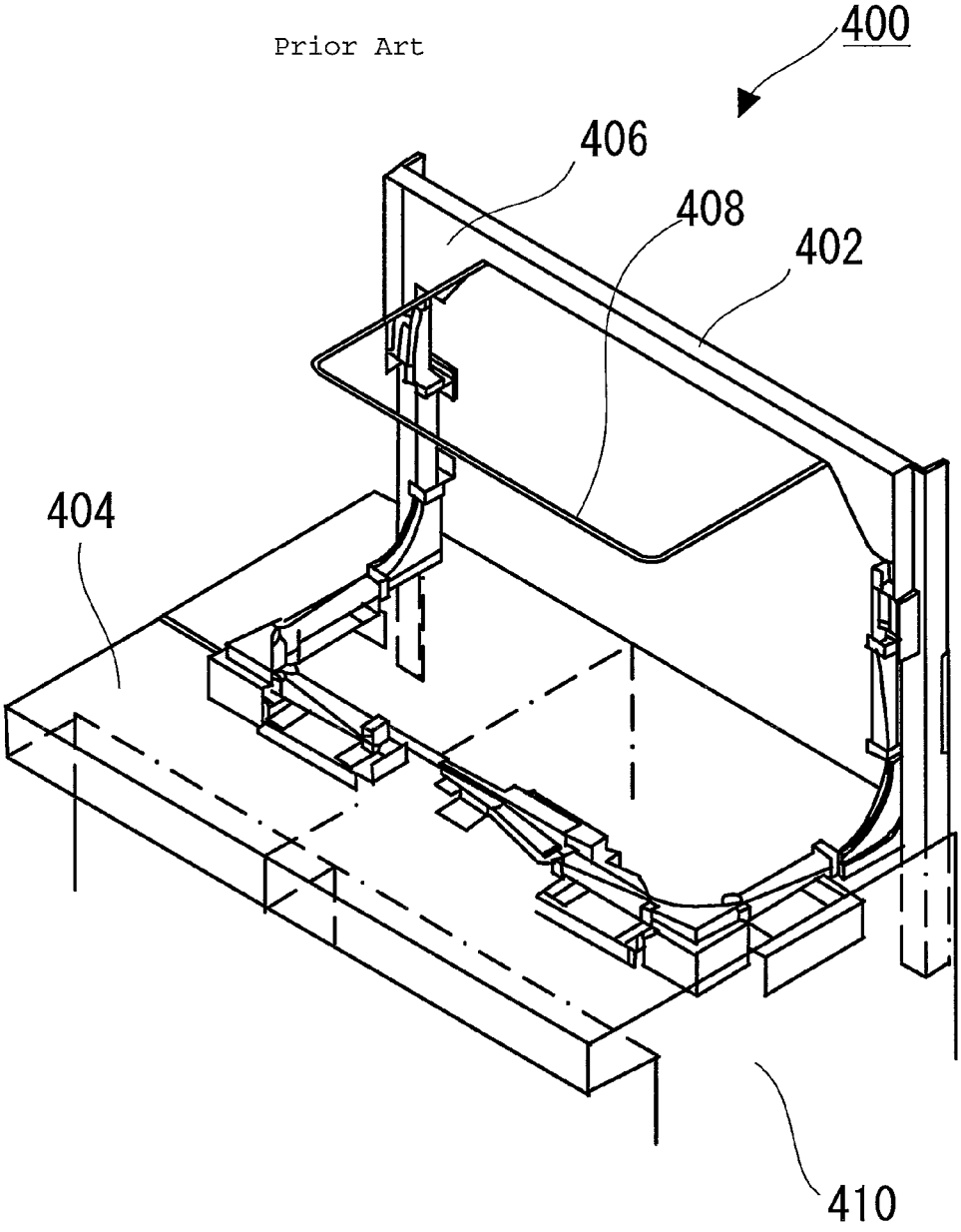
Fig 17 Prior Art
FIG. 17 is a partially enlarged perspective view of the conventional automatic banding packing machine.
Figure 18:
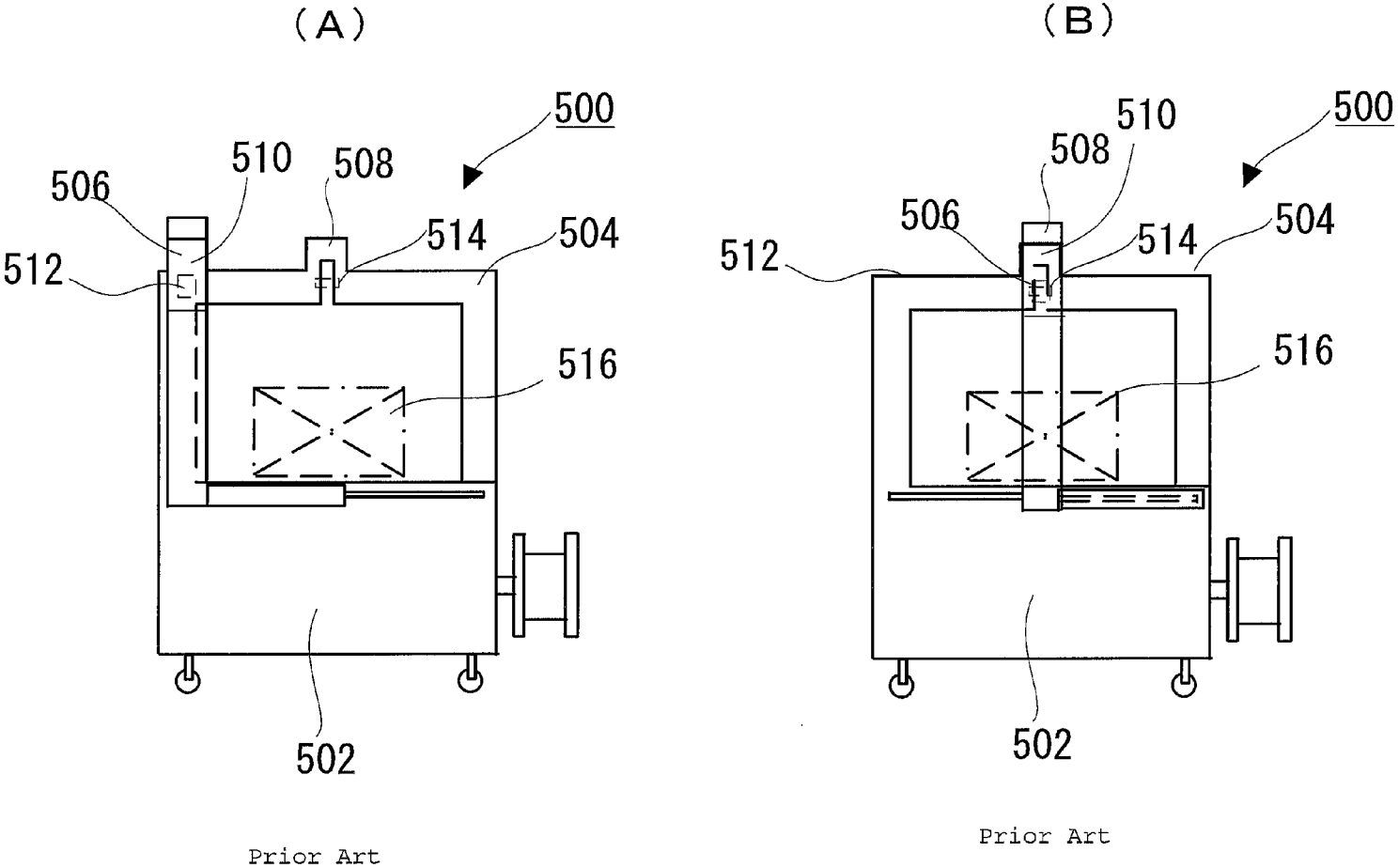
FIG. 18 is a front view for explaining an operation of the conventional automatic banding packing machine.

Also, on the upstream side of the one automatic banding packing machine 74, the other automatic banding packing machine 76 with the configuration as described in the related art shown in FIG. 12 for banding on the object to be packed 72 in the direction orthogonal to the passage direction of the object to be packed 72 of the one automatic banding packing machine 74 is arranged.

And the object to be packed 72 is carried into the other automatic banding packing machine 76 through a first conveying line 78, and at the other automatic banding packing machine 76, banding is performed on the object to be packed 72 in the direction orthogonal to the passage direction of the object to be packed 72 of the one automatic banding packing machine 74 (See the object to be packed 72 on a second conveying line 80 in FIG. 9) and carried into the one automatic banding packing machine 74 through the second conveying line 80.

The object to be packed 72 having been carried into the one automatic banding packing machine 74 is banded in the cross state at the one automatic banding packing machine 74 in parallel with the passage direction of the object to be packed 72 (See the object to be packed 72 on the third conveying line 82 in FIG. 9) and carried out through a third conveying line 82.

Therefore, in the automatic banding packing system 70 of this embodiment, the two automatic banding packing machines 74, 76 are set to be arranged adjacently so that the passage direction of the object to be packed 72 becomes a straight line through the first conveying line 78, the second conveying line 80, and the third conveying line 82.

In the automatic banding packing system 70 configured as above, when the object to be packed 72 is to be packed in the cross state by a band, first, the object to be packed 72 is carried into the other automatic banding packing machine 76 through the first conveying line 78 and at the other automatic banding packing machine 76, the object to be packed 72 is banded in the direction orthogonal to the passage direction of the object to be packed 72 of the one automatic banding packing machine 74 (right and left direction in FIG. 9) (See the object to be packed 72 on the second conveying line 80 in FIG. 9).

Next, by extending the piston by driving the cylinder device 50, the vertical band guide arches 36, 38 of the one automatic banding packing machine 74 are moved to the standby position in advance (position indicated by a dotted line in FIG. 9).

And through the second conveying line 80, the object to be packed 72 is carried into the one automatic banding packing machine 74 and moved to the packing position (center position in the conveying direction of the automatic banding packing machine 74).

In this state, by contracting the piston by driving the cylinder device 50, by moving the vertical band guide arches 36, 38 to the communication position, and after supplying a band into the pair of the vertical band guide arches 36, 38 and the horizontal band guide arch 32 in this state, the object to be packed 72 is banded in the direction parallel with the passage direction of the object to be packed 72 of the one automatic banding packing machine 74 (front and rear direction in FIG. 9) for performing banding in the cross state (See the object to be packed 72 on the third conveying line 82 in FIG. 9).

With such configuration, by the one automatic banding packing machine 74, the object to be packed 72 can be banded in parallel with the passage direction of the object to be packed 72, and by the other automatic banding packing machine 76, the object to be packed 72 can be banded in the direction orthogonal to the passage direction of the object to be packed 72 of the one automatic banding packing machine 74 and bundled so that the object to be packed 72 can be banded in the cross state.

Moreover, even if the two automatic banding packing machines 74, 76 are arranged adjacently so that the passage direction of the object to be packed 72 becomes a straight line, the cross banding can be performed, and one automatic banding packing machine and the other automatic banding packing machine can be arranged in a straight state, not in a right angle state as before, which can make the installation space small and simplify the entire structure.

Figure 10:
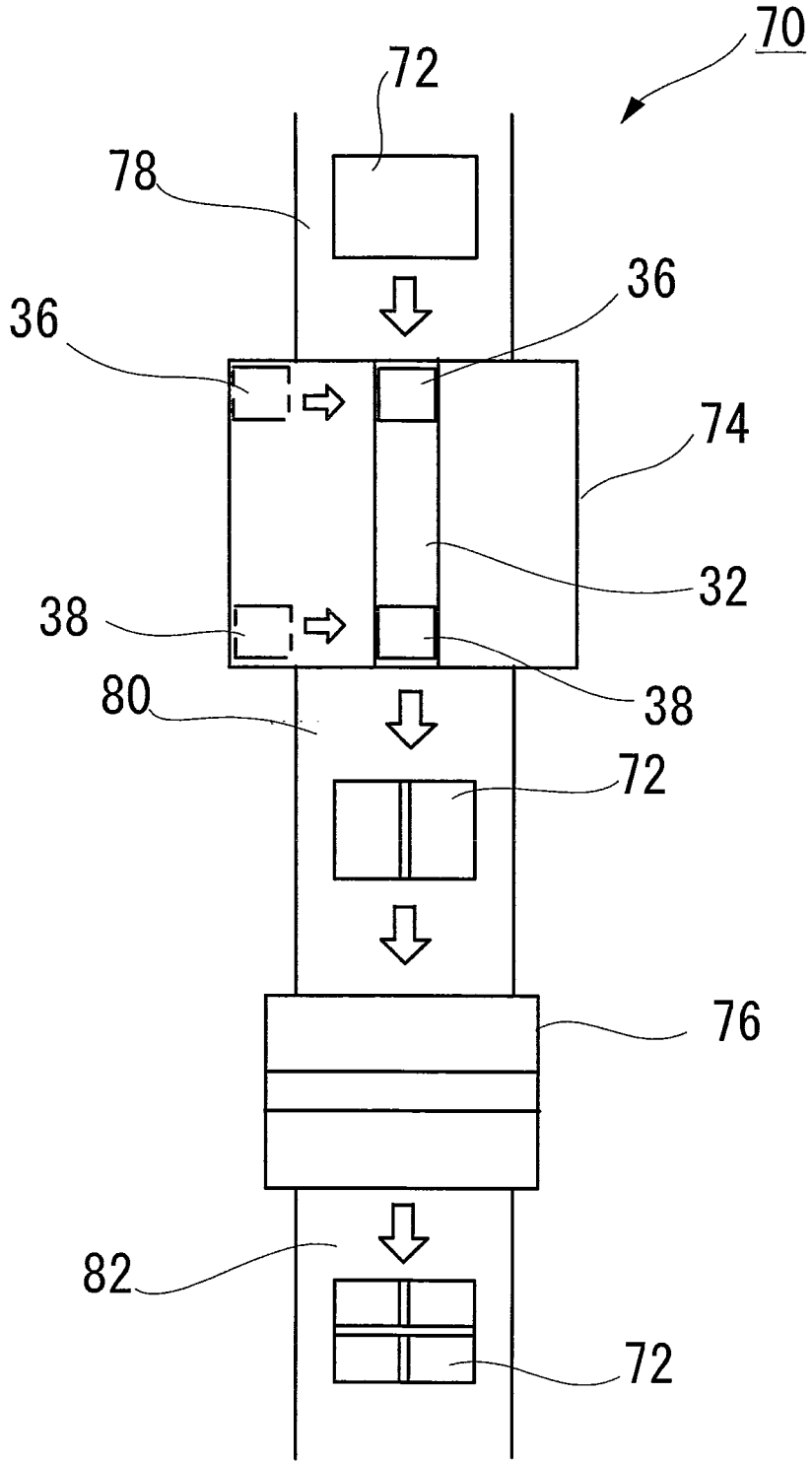
FIG. 10 is an outline plan view illustrating another embodiment of an automatic banding packing system 70 using an automatic banding packing machine 10 of the present invention.

In this embodiment, the one automatic banding packing machine 74 for banding on the object to be packed 72 in parallel with the passage direction of the object to be packed 72 is arranged on the downstream side and the other automatic banding packing machine 76 for banding on the object to be packed 72 in the direction orthogonal to the passage direction of the object to be packed 72 of the one automatic banding packing machine 74 is arranged on the upstream side of the one automatic banding packing machine 74 in the configuration as mentioned in the related art shown in FIG. 12, but the inverse configuration, that is, the one automatic banding packing machine 74 may be arranged on the upstream side and the other automatic banding packing machine 76 on the downstream side of the one automatic banding packing machine 74 as shown in FIG. 10.

With such configuration, the one automatic banding packing machine 74 for banding in parallel with the passage direction of the object to be packed and the other automatic banding packing machine 76 for banding on the object to be packed 72 in the direction orthogonal to the passage direction of the object to be packed 72 of the one automatic banding packing machine 74 can be freely arranged on the upstream side or the downstream side, and design freedom is improved.

Figure 11:
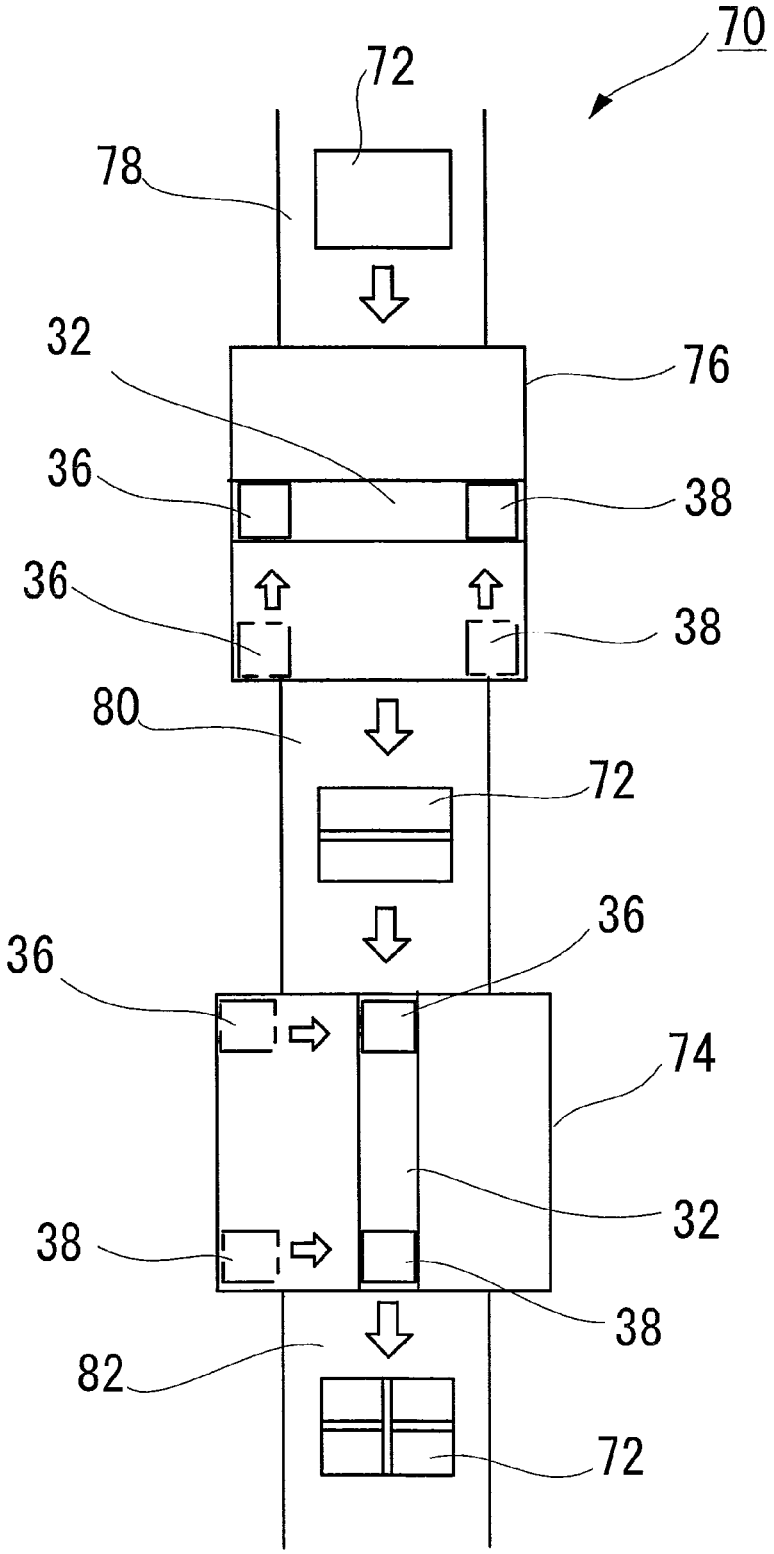
FIG. 11 is an outline plan view illustrating another embodiment of an automatic banding packing system 70 using an automatic banding packing machine 10 of the present invention.

Also, as shown in FIG. 11, the other automatic banding packing machine 76 may be constituted by the automatic banding packing machine 10 of the present invention.

In this case, as shown in FIG. 11, when the other automatic banding packing machine 76 is constituted by the automatic banding packing machine 10 of the present invention, the horizontal band guide arch 32 may be set to be arranged in parallel with the direction orthogonal to the passage direction of the object to be packed 72 so that the front and rear direction in FIG. 1 becomes the conveying direction of the object to be packed 72 in the automatic banding packing machine 10.

With such configuration, by constituting not only the one automatic banding packing machine 74 but also the other automatic banding packing machine 76 by the automatic banding packing machine 10 of the present invention, there is no need to perform the packing work by arranging the automatic banding packing machine with a different structure as before, and its control system does not become complicated and the control system itself is simplified.

The preferred embodiments of the present invention have been described above, but the present invention is not limited to them. For example, in the embodiment, the banding is performed on the object to be packed, but other than a band, other bundling members such as a banding state or chain state one can be used, for example. Moreover, in the above embodiment, the automatic banding packing system in which the automatic banding packing machine is arranged on a plane has been described, but the machine can be arranged not on a plane but in the vertical direction or three-dimensionally. As such, various changes are possible within a range not departing from the object of the present invention.

The invention claimed is:

1. An automatic banding packing machine comprising:

a packing machine body having an upper-face table on which a narrow groove is formed in a direction parallel with a passage direction of an object to be packed;

a right-side vertical band guide arch and a left-side vertical band guide arch arranged above the upper-face table separately from each other in a direction parallel with the passage direction of the object to be packed;

a rear connection bar arranged above the upper-face table in a direction parallel with the passage direction of the object to be packed separately from a horizontal band guide arch;

a linkage mechanism connecting the right-side vertical band guide arch and the left-side vertical band guide arch with the rear connection bar; and the horizontal band guide arch arranged above the upper-face table in a direction parallel with the passage direction of the object to be packed, such that the horizontal band guide arch is opposite to the narrow groove, wherein the right-side vertical band guide arch and the left-side vertical band guide arch are constituted capable of moving their positions between a standby position separated from the horizontal band guide arch and a communication position aligned with the horizontal band guide arch packed, and when the right-side vertical band guide arch and the left-side vertical band guide arch are in the communication position aligned with the horizontal band guide arch, the right-side vertical band guide arch, the left-side vertical band guide arch, the horizontal band guide arch, and the narrow groove form a loop-shaped band passage.

* * * * *

UNITED STATES PATENT AND TRADEMARK OFFICE

CERTIFICATE OF CORRECTION

PATENT NO. : 8,997,641 B2
APPLICATION NO. : 12/670021
DATED : April 7, 2015
INVENTOR(S) : Keisho Yamamoto et al.

It is certified that error appears in the above-identified patent and that said Letters Patent is hereby corrected as shown below:

IN THE CLAIMS:

Column 16, Lines 49-50, Claim 1, delete "arch packed, and" and insert -- arch, and --

Signed and Sealed this
Eleventh Day of August, 2015

Michelle K. Lee

Michelle K. Lee
*Director of the United States Patent and Trademark Office*